US006571417B1

(12) United States Patent
Gavney, Jr. et al.

(10) Patent No.: US 6,571,417 B1
(45) Date of Patent: Jun. 3, 2003

(54) DENTITION CLEANING DEVICE AND SYSTEM

(76) Inventors: James Albert Gavney, Jr., 996 Amarillo, Palo Alto, CA (US) 94303; Gregory Lee Keaton, 3874 18th St., San Francisco, CA (US) 94114

( * ) Notice: Subject to any disclaimer, the term of this patent is extended or adjusted under 35 U.S.C. 154(b) by 183 days.

(21) Appl. No.: 09/588,686

(22) Filed: Jun. 5, 2000

Related U.S. Application Data

(63) Continuation-in-part of application No. 09/330,704, filed on Jun. 11, 1999.

(51) Int. Cl.[7] ..... A47L 13/11; A47L 13/12

(52) U.S. Cl. ..... 15/117; 15/167.1; 15/188; 15/245

(58) Field of Search ..... 15/22.1, 110, 121, 15/187, 188, 245, 167.1, 114; D32/41

(56) References Cited

U.S. PATENT DOCUMENTS

| | | | | |
|---|---|---|---|---|
| 34,109 | A | | 1/1862 | Fanshaw et al. |
| 116,030 | A | * | 6/1871 | Devines |
| 218,431 | A | | 8/1879 | Dunham |
| 411,910 | A | * | 10/1889 | Van Horne |
| 742,639 | A | | 10/1903 | Harlan |
| 907,842 | A | | 12/1908 | Meuzies |
| 915,251 | A | | 3/1909 | Vanderslice |
| 1,006,630 | A | | 10/1911 | Clarke |
| 1,128,139 | A | | 2/1915 | Hoffman |
| 1,142,698 | A | | 6/1915 | Grove et al. |
| 1,188,823 | A | * | 6/1916 | Plank |
| 1,191,556 | A | | 7/1916 | Blake ..... 15/117 |
| 1,297,272 | A | | 3/1919 | Strang et al. |
| 1,405,279 | A | * | 1/1922 | Cassedy |
| 1,526,267 | A | * | 2/1925 | Dessau |
| 1,578,074 | A | | 3/1926 | Chandler |

(List continued on next page.)

FOREIGN PATENT DOCUMENTS

| | | |
|---|---|---|
| DE | 31 14 507 A1 | 3/1983 |
| DE | 298 16 488 U1 | 1/1999 |
| DE | 199 57 639 A1 | 6/2001 |
| FR | 2 793 136 | 11/2000 |
| GB | 290515 | 5/1928 |
| GB | 305735 | 2/1929 |
| GB | 620151 | 3/1946 |
| WO | WO 98/18364 | 5/1998 |

OTHER PUBLICATIONS

Our Response to the ADA's Press Release of Apr. 12, 1999, copied from the web–site at http://www.toothbrush-lawsuit.com.

A toothbrush versus gum stimulator report copied from the web–site at http://www.oralb.com/pro/library/library.nsf/.

A study of plaque removal with novel brush designs copied from the web–site at http://oralb.com/pro/library/library.nsf/.

*Primary Examiner*—Terrence R. Till
(74) *Attorney, Agent, or Firm*—Haverstock & Owens LLP

(57) ABSTRACT

A dentition cleaning device and system is disclosed for cleaning teeth, gums and dentures. The dentition cleaning device utilizes squeegees that protrude from a cleaning head to provide efficient contact of dentition surfaces during cleaning. The dentition cleaning device is particularly useful for cleaning teeth because the squeegee contact surfaces and remove residues, such as plaque, without causing significant abrasion to surrounding gum tissue which can lead to gum recession. The dentition cleaning device can be configured with bristle sections or with squeegees that are configured to retain water in squeegee channels. The dentition cleaning device is adaptable to water assisted tooth cleaning system and motorized electric teeth cleaning systems. The dentition cleaning device is also particularly useful to be used in conjunction with a low viscosity tooth cleaner that is capable of being delivered through a conventional pump dispenser.

39 Claims, 23 Drawing Sheets

U.S. PATENT DOCUMENTS 1,705,249 A * 3/1929 Henry
1,910,414 A 5/1933 Varga ..... 15/245
1,924,152 A 9/1933 Coney et al.
2,088,839 A 8/1937 Coney et al.
2,139,245 A 12/1938 Ogden
2,154,846 A 4/1939 Heymann et al.
2,219,753 A 10/1940 Segun
2,244,699 A * 6/1941 Hosey
2,279,355 A 4/1942 Wilensky
2,334,796 A 11/1943 Steinmetz et al.
2,443,461 A * 6/1948 Kempster
2,516,491 A * 7/1950 Swastek
2,534,086 A 12/1950 Vosbikian et al.
2,545,814 A * 3/1951 Kempster
2,637,870 A 5/1953 Cohen ..... 15/188
3,103,027 A 9/1963 Birch ..... 15/110
3,110,052 A 11/1963 Whitman
3,133,546 A 5/1964 Dent
3,181,193 A 5/1965 Nobles et al.
3,230,562 A 1/1966 Birch
3,359,588 A 12/1967 Kobler
3,491,396 A 1/1970 Eannarino et al. ..... 15/104.94
3,553,759 A 1/1971 Kramer et al.
3,641,610 A 2/1972 Lewis, Jr.
3,939,522 A 2/1976 Shimizu
4,115,893 A 9/1978 Nakata et al. ..... 15/110
4,128,910 A 12/1978 Nakata et al. ..... 15/110
4,167,794 A 9/1979 Pomeroy
4,277,862 A 7/1981 Weideman ..... 15/110
4,428,091 A 1/1984 Janssen ..... 15/167
4,573,920 A 3/1986 d'Argembeau ..... 433/141
4,585,416 A 4/1986 DeNiro et al. ..... 433/140
4,610,043 A 9/1986 Vezjak ..... 15/111
4,763,380 A 8/1988 Sandvick ..... 15/160
4,812,070 A 3/1989 Marty
4,866,806 A 9/1989 Bedford
5,005,246 A 4/1991 Yen-Hui ..... 15/111
5,032,082 A 7/1991 Herrera ..... 433/141
5,040,260 A 8/1991 Michaels
5,211,494 A 5/1993 Baijnath ..... 401/28
5,226,197 A 7/1993 Nack et al. ..... 15/11
5,283,921 A * 2/1994 Ng
5,528,793 A 6/1996 Schbot ..... 15/245
5,628,082 A 5/1997 Moskovich ..... 15/110
5,711,759 A 1/1998 Smith et al.
5,806,127 A * 9/1998 Samoil et al.
5,810,856 A 9/1998 Tveras ..... 606/161
5,896,614 A 4/1999 Flewitt
5,966,771 A 10/1999 Stroud ..... 15/117
6,041,467 A 3/2000 Roberts et al. ..... 15/167.1
6,065,890 A 5/2000 Weitz ..... 401/146
6,067,684 A 5/2000 Kweon ..... 15/167.1
6,077,360 A 6/2000 Takashima
6,085,379 A 7/2000 Stafford ..... 15/167.1
6,108,854 A 8/2000 Dingert ..... 15/188
6,115,871 A 9/2000 Royer ..... 15/167.2
6,168,434 B1 1/2001 Rohm-Van Diggelen
6,182,323 B1 2/2001 Bahten
6,182,365 B1 2/2001 Tseng et al.
6,245,032 B1 6/2001 Sauer et al.
6,272,713 B1 8/2001 Lotwin
6,319,332 B1 11/2001 Gavney, Jr. et al.
2001/0039689 A1 11/2001 Gavney, Jr.

* cited by examiner

DENTITION CLEANING DEVICE AND SYSTEM

RELATED APPLICATIONS

This application is a continuation-in-part of the co-pending application Ser. No. 09/330,704 entitled "Squeegee Device and System " filed Jun. 11, 1999, the contents of which is hereby incorporated by reference.

FIELD OF THE INVENTION

This invention relates generally to dentition cleaning devices and dentition cleaning systems. More specifically the invention relates to dentition cleaning devices and dentition cleaning systems that clean teeth, gums and dentures through contact.

BACKGROUND

The toothbrush is the most common instrument for cleaning teeth, gums, and other areas of the mouth. A toothbrush, unfortunately, is an inefficient device for removing plaque and stains from the enamel surfaces of teeth and is poorly suited for cleaning the surfaces of gum tissue. The inefficiency arises because plaque, while relatively soft, strongly adheres to enamel surfaces of the teeth. Because, plaque strongly adheres to enamel surfaces of teeth, brushing convection does not readily remove plaque. In order to remove all the plaque from the enamel surfaces of the teeth, bristles must contact each point on the surfaces of the teeth. Even where bristles contact the enamel surfaces of the teeth during a cleaning operation, the toothbrush generally fails to remove stains.

A further disadvantage of toothbrushing is the tendency of the toothbrush to cause gum abrasion, or toothbrush abrasion. The main symptom of toothbrush abrasion is gingival recession, or receding gums, often found in people who brush their teeth frequently. As the gums recede, sensitive parts of the teeth are exposed, generally resulting in painful reactions to hot and cold foods. Frequent brushing of the teeth, even with a very soft bristle toothbrush can lead to a condition of gingival recession. Furthermore, gingival recession is a progressive condition: it never improves but only worsens with time. In fact, toothbrushing as the leading cause of gingival recession is the subject of a current national class action lawsuit against toothbrush manufacturers, Trimarco vs. Colgate Palmolive et al., filed in Cook County, Ill. More information about toothbrush abrasion can be found at the Internet address www.toothbrushlawsuit.com. Although the connection between toothbrushes and receding gums has been documented for over half a century, progress in the field of dentition cleaning devices designed to reduce or eliminate receding gums has been tortuously slow.

In addition to causing gingival recession, toothbrushes are difficult to keep clean, because the bristles have a tendency to accumulate and trap debris. Further, toothbrushes have the propensity to retain water and remain moist long after brushing thus providing an excellent place for the cultivation of bacteria, germs and the like.

There have been several attempts to improve oral hygiene by providing cleaning devices that help remove plaque from the tongue, the gums and the palate. For example, Vezjak describes an oral hygiene brush in U.S. Pat. No. 4,610,043 that comprises a toothbrush and a rigid plaque scraper mounted on the side of the toothbrush head. The plaque scraper is engineered for removing plaque from the tongue, and Vezjak's device requires that a toothbrush still be used for cleaning teeth. Herrera, in U.S. Pat. No. 5,032,082 discloses a device for removing denture adhesive from the palate. The device comprises a head that has several lines of projections extending from a common surface. The projections are made of a material whose flexibility is temperature dependent, so that submerging the projections in hot water makes them more pliable, and placing them in cold water makes them more rigid. This device is tailored toward removing adhesive from the mouth, and cannot be effectively used for cleaning teeth. Tveras, in U.S. Pat. No. 5,810,856 discloses an oral scraping device having at least one wiping element. Each wiping element is flexible, and has at least one scoop-like side that terminates in a wiping edge in an undercutting fashion. This device is designed for scraping the tongue, and in the preferred embodiment, is mounted on a toothbrush handle on the end opposite the toothbrush head. Thus, using the device of Tveras, teeth must still be cleaned with a toothbrush.

The effects of gum stimulators were studied recently by M. J. Cronin et al., "Anti-Gingivitis Efficacy of Toothbrushing Compared to Toothbrushing and Gum Stimulation, " Journal of Dental Research 78 (Special Issue), 1999, p. 149. In this study, a group of test subjects used selected toothbrushes and gum stimulators regularly, and were compared to a control group that used the toothbrushes alone. The researchers found that the toothbrushes provided the same benefit in reducing gingival bleeding as the toothbrushes and gum stimulators combined. However, this study did not address the problem of gingival recession, nor did it provide an alternative to toothbrushing for cleaning teeth.

What is needed is an efficient contact dentition cleaning device and system that provides an alternative to using a toothbrush for cleaning teeth and that is capable of reducing bristle abrasion to the surrounding gum tissue.

SUMMARY OF THE INVENTION

The invention is a dentition cleaning device and system that provides an alternative to using a bristle-only toothbrush. The dentition cleaning device has at least one squeegee that contacts the surface of the teeth during a cleaning operation. The squeegee may be used in combination with bristles or bristle sections that also contact teeth during cleaning. The bristle sections clean the teeth with brushing convection, much like a conventional tooth brush, while the squeegee wipes the surfaces of the teeth to improve the efficiency of teeth cleaning. Alternatively, the squeegee is configured to confine bristle portions of the device from directly contacting the gum tissue, while a squeegee messages the gums during cleaning of the teeth.

In alternative embodiments, a continuous squeegee encircles the outer portion of the cleaning head allowing the device to be used in conjunction with low viscosity cleaning solutions or allows the cleaning head to be equipped with a scaled cap that can be removed when the device is ready for use. Sealing the cleaning head with a cap can help to keep the cleaning head sanitary during storage and/or can help enclose an oral cleaning material within the cleaning head making the device particularly useful and convenient to used during traveling, camping and the like.

Several embodiments of the invention provide for a plurality of squeegee cleaning directions that enhance the efficiency of cleaning dentition. The plurality of cleaning directions is achieved by supplying several elongated squeegees having different orientations or at least one squeegee that curves, as described in detail below.

Other embodiments of the present invention provide a dentition cleaning device and system that utilize squeegees that extend in several directions and form squeegee channels or compartments. The channels or compartments are preferably capable of holding water or cleaning solutions, allowing the device to wet the surface of dentition during cleaning.

Yet other embodiments of the invention provide for oral squeegee cleaning in a plurality of wiping planes. Because several wiping planes are provided, the device and system is capable of simultaneously contacting non-planar dentition surfaces or irregular dentition surfaces with edges of the squeegees. Configuring the device with different squeegee heights, different squeegee protruding directions, contoured squeegee edges, or combinations thereof, which provides for the plurality of squeegee wiping planes.

Still other embodiments of the invention do not utilize bristles or bristle sections. These embodiments utilize only squeegee cleaning elements to provide a dentition cleaning device. Such bristle-free embodiments provide for a dentition cleaning device and system that is highly sanitary because the cleaning head is less likely to trap debris and moisture which can lead to bacterial to growth between uses of or during storage of the device.

Still other embodiments of the invention, provide for a device and system that stores an oral cleaning substance in a handle portion of the device. The cleaning substance is delivered to the cleaning head of the device through apertures at or near the cleaning head. The handle is preferably equipped with a pumping mechanism to deliver the oral cleaning substance to the cleaning head. Alternatively the cleaning substance is delivered to the cleaning head by squeezing a compressible handle.

Other embodiments of the invention provide oral cleaning heads that are attachable to electric or motorized handles. The electric handles provide back and forth or rotational agitation during cleaning of dentition.

Still other embodiments of the invention utilize cleaning heads with a squeegee element that has bristles that are attached to the squeegee element. The squeegee element helps to guide the bristles into sections of dentition that require detailed or special cleaning. These embodiments are especially useful for persons that wear corrective braces or other corrective devices on their teeth.

The dentition cleaning device and system of the current invention has many useful applications besides cleaning of dentition. Bristle-free embodiments of the invention are useful as general tissue massagers to message any soft or delicate tissue where a bristle device is undesirable. For example, the device is useful to messages sore gums of teething babies or adults after oral surgery. Embodiments of the invention are useful as applicators to apply plaque removers, sealants, glues, mediations and other substances to dentition.

In the most preferred embodiments of the current invention the dentition cleaning system and device is a manual hand-held system and device with an elongated handle attached to the dentition cleaning head. The handle and the cleaning head are configured to be detachable so the different dentition cleaning heads may be used with a single handle. The dentition cleaning head is preferably similar in size to a conventional toothbrush cleaning head for easy and comfortable insertion into a human oral cavity. It is, however, understood that there may be reasons to miniaturize or enlarge the system and device for a particular application at hand.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

Figure 1A:
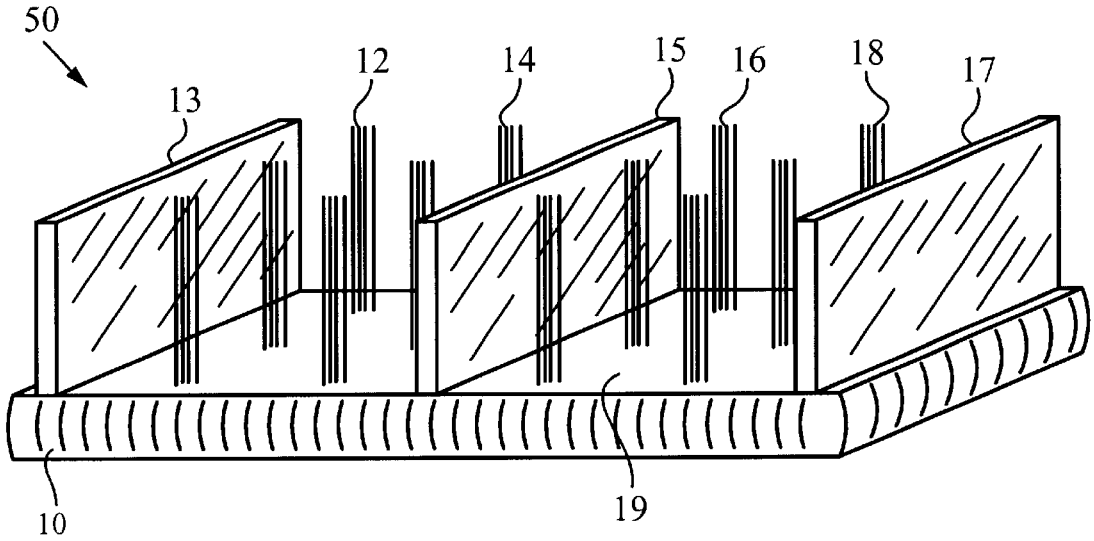
FIG. 1*a* shows a cleaning device configured with bristle sections and linear elongated squeegees.

FIG. 1*a* shows a cleaning head 50 configured with rows bristle sections 12, 14, 16 and 18 protruding from a surface 19 of a support member 10. Protruding in a similar direction to the rows of bristle section, are squeegee segments 13, 15 and 17. The bristle sections 12, 14, 16 and 18 and the squeegee segments 13, 15 and 17 are preferably capable of contacting a surface (not shown) simultaneously during a cleaning operation.

Figure 1B:
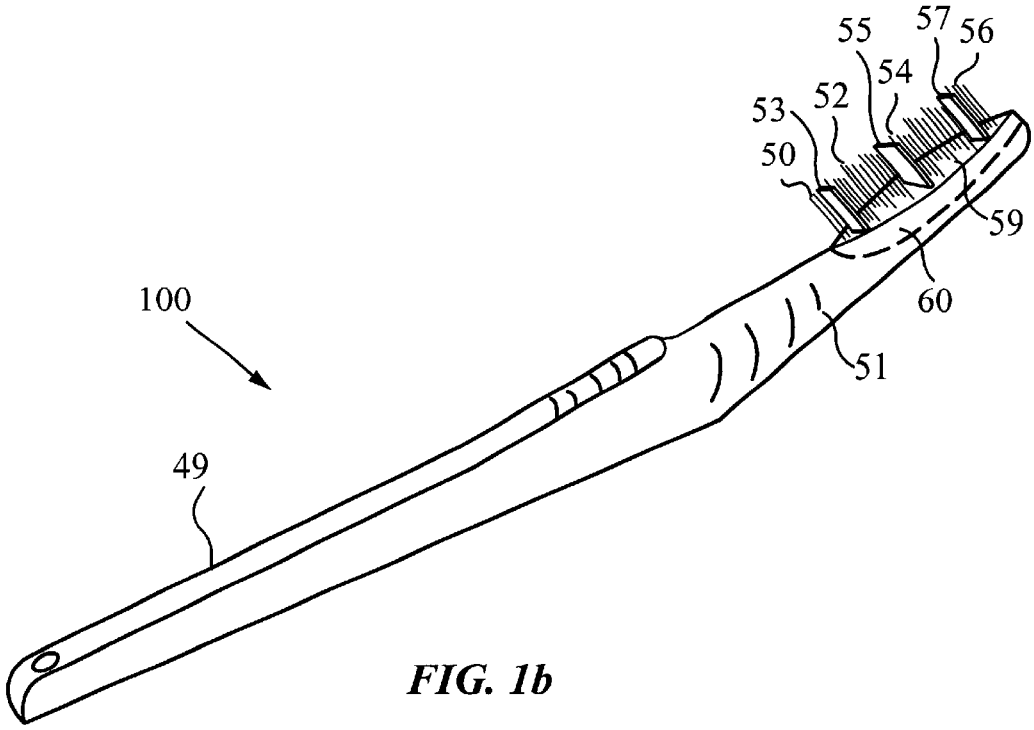
FIG. 1*b* illustrates a dentition cleaning device with bristle sections and linear elongated squeegees in accordance with current invention.

FIG. 1*b* illustrates a dentition cleaning device 100 according to one embodiment of the current invention. The dentition cleaning device 100 employs a cleaning head configuration with a design that is similar to that shown in FIG. 1*a*. The bristle sections 50, 52, 54 and 56 protrude from a surface or support 59 in a bristle protruding direction. The bristles are preferably made of synthetic or natural bristle materials well known in the art, such as plastics or natural course hair. The dentition cleaning device 100 also has squeegee members 53, 55 and 57 that protrude from the surface 59 in a squeegee protruding direction that is substantially similar to the bristle protruding direction. Preferably, the bristles and squeegee members are both capable of connecting surfaces of dentition during cleaning operations. FIG. 1*b* is set forth herein for illustrative purposes and a number of different bristle section configurations and squeegee configurations are considered to be within the scope of the current invention.

Again referring to FIG. 1*b*, in one embodiment of the current invention an outer continuous squeegee member (not shown) encircles the bristle sections 50, 52, 54 and 56 and/or the linear squeegee members 53, 55 and 57 to help prevent the bristles sections 50 52, 54 and 56 from contacting the surfaces of gum tissues during cleaning of the teeth, while the outer continuous squeegee member messages gum tissue. A continuous outer squeegee member also serves the purpose of containing or holding low viscosity cleaning solutions as described in later embodiments. Alternatively, squeegee segments (not shown) protrude from or near the edges of the surface 59, for the purpose of protecting the gums from contact with the bristle and for messaging the gums while cleaning the teeth.

Still referring to FIG. 1*b*, in a particular embodiment of the invention the surface 59 of a support section 60 is made from a soft malleable material to which the bristle sections and the squeegee section are attached. The support section 60 is then attached to the toothbrush body 51 by any means known in the art. The support section 60 provides a suspension for the bristle sections 50, 52, 54 and 56 and for the squeegees 53, 55 and 57 such that the bristle sections and squeegees are capable of being partially displaced from their resting positions when pressure is applied to the cleaning tips of the bristles or cleaning edges of the squeegees. The support section 60 thus provides a mechanism for the bristle sections and the squeegees to conform to irregular surfaces of dentition during cleaning.

Again referring to FIG. 1*b*, the dentition cleaning device 100, as shown, has a handle 49 integrated with a body 51. While the dentition cleaning device 100 is shown as a monolithic unit, it will be clear to one of average skill in the art that the handle 49 and body 51 may be configured to be detachable so that several dentition cleaning heads can be used with a single handle 49. Further, the body head 51 maybe configured to be detachably fastened to a motorized handle (not shown) for providing agitation to dentition similar to an electric toothbrush. It should also be noted that the support member 60 may be detachably fastened to the body head 51 such that the support member 60 and its attached cleaning elements (i.e. bristles and squeegees) are replaceable.

Figure 2A:
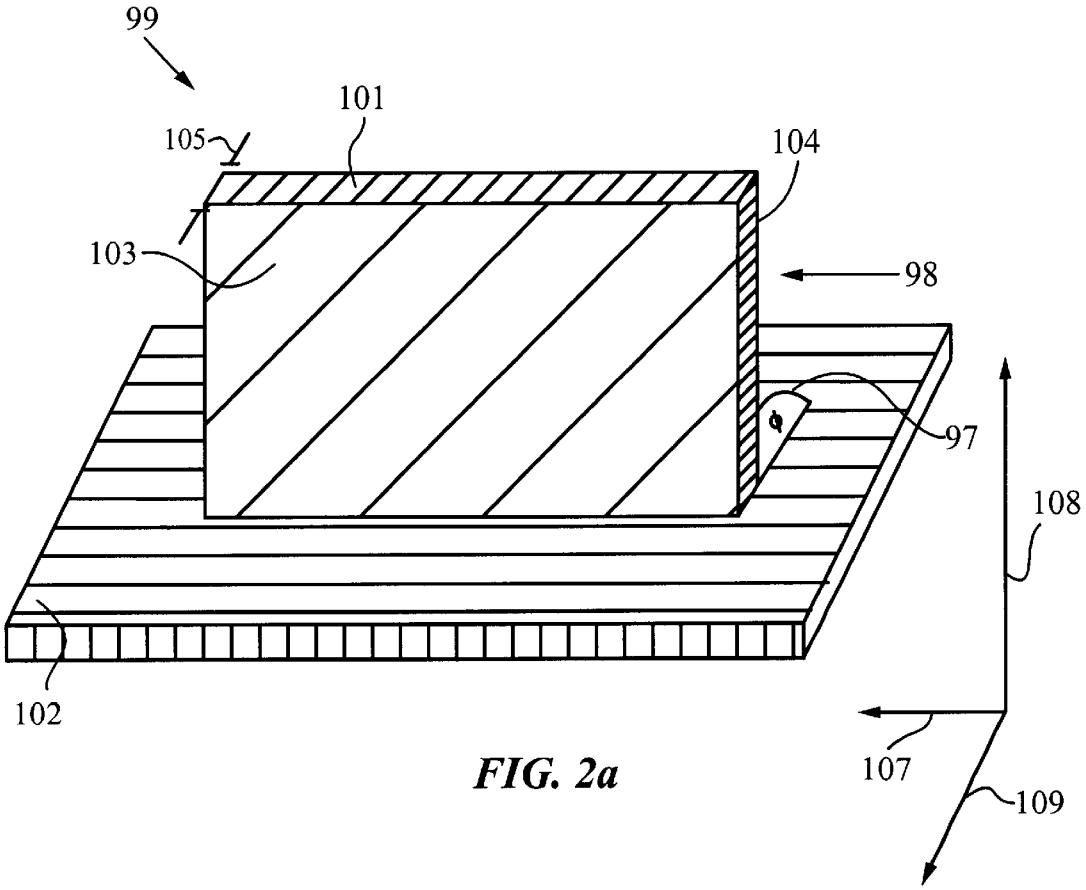
FIG. 2*a* illustrates a perspective view of an elongated squeegee member.

FIG. 2*a* shows a perspective view of a squeegee structure 99 with a squeegee member 98 that protrudes from a support member 102 in a protruding direction 108. The squeegee member 98 has a protruding edge, or cleaning edge, 101 that contacts a surface during a cleaning operation. The squeegee member 98 is elongated in an elongation direction 107 with two elongated squeegee walls 103/104. At any point on the surface of the squeegee walls 103/104, the squeegee member 98 has a squeegee wall thickness 105. The primary squeegee direction 109 is defined, herein, as any co-linear direction that is normal to the elongation direction 107 at each point along elongation direction 107. Strictly speaking, for any elongated squeegee there will be at least two wiping directions, corresponding to a back and forth cleaning motion along the line of primary squeegee direction 109. For the sake of simplicity and for this description, squeegee action along any straight line of motion is referred to as a single direction. Thus, the linear elongated squeegee 98 provides for one primary squeegee direction, regardless of a protruding angle 97 or curvature of the squeegee wall in the protruding direction 108. Further, for clarity and descriptive purpose, elongated squeegees and squeegee supports are usually described as separated elements herein. However, it is clear that squeegees and squeegee supports may be monolithic and made of the same or different materials. Further, the shapes of supports are not limited to circles or squares as generally described herein; squeegee supports may take any shape or form that is reasonable for the application at hand.

The current invention utilizes elongated squeegees in the numerous configurations described below to provide an effective dentition cleaning device. The elongated squeegees are preferably made from a soft flexible, pliable or malleable material such as rubber, latex, urethane, silicone and the like. The flexibility, pliability or malleability of the squeegees are preferably in the range between 10 to 50 Shore A durometers as measured with durometer gauges well known in the art. The dimensions of the squeegees can vary in the numerous ways described below but preferably protrude from a support surface by an average distance of 0.1 to 3.0 cm in the squeegee protruding direction 108. Further, while the squeegee wall thickness 105 can vary at any point between the squeegee walls 103 and 104, the squeegee wall thicknesses are preferably within the range of 0.1 to 5.0 mm.

Figure 2B:
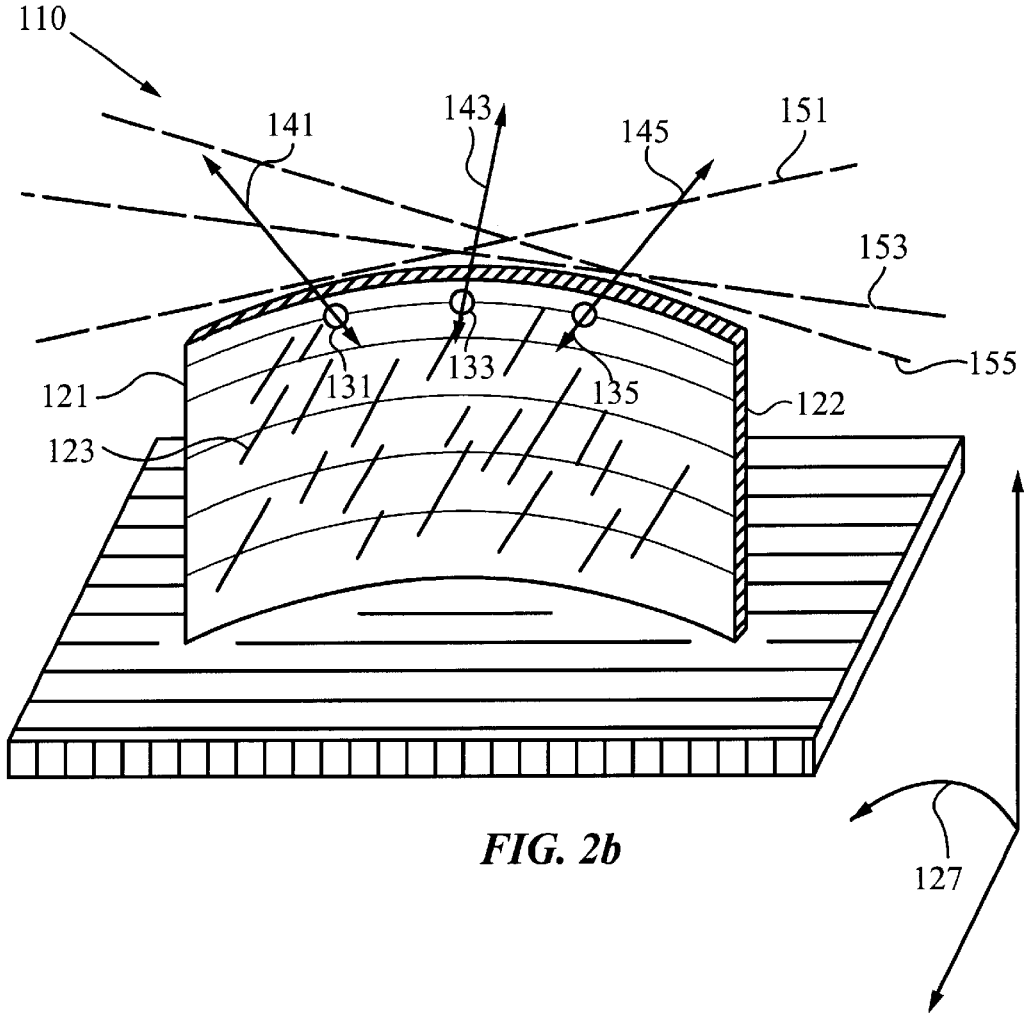
FIG. 2*b* illustrates a perspective view of an elongated curved squeegee member.

FIG. 2*b* illustrates a squeegee structure 110 with a curved squeegee member 121 that is curved in the elongation directions 127. Curved squeegee members, such as 121 are particularly useful in the current invention. Geometric considerations will reveal that each point on the curved squeegee wall 122/123 corresponds to a primary squeegee direction in the direction that is normal to a tangent line of the squeegee curvature. For example points 131, 133 and 135 have tangent lines of curvature 151, 153 and 155, respectively, and corresponding primary squeegee directions 141, 143 and 145.

Figure 2C:
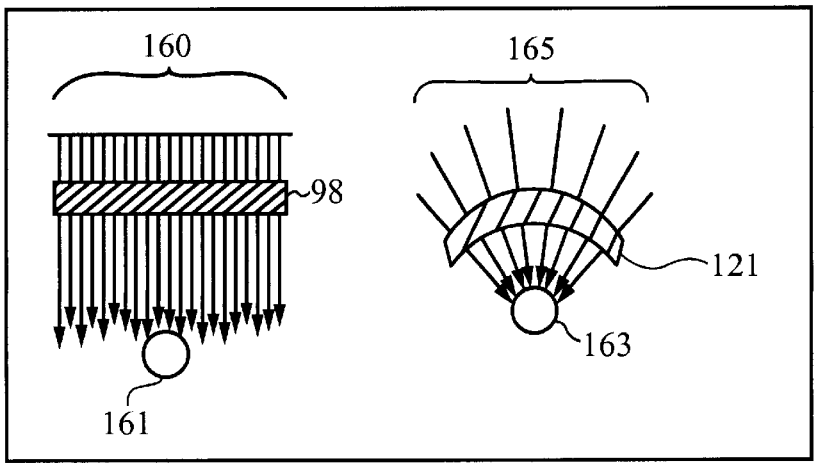
FIG. 2*c* compares the primary squeegee directions provided by the linear squeegee member of FIG. 2*a* and the curved squeegee member of FIG. 2*b*.

FIG. 2*c* compares the primary squeegee directions provided by the linear squeegee member of FIG. 2*a* and the curved squeegee member of FIG. 2*b*. It can be seen from FIG. 2*c*, that the curved squeegee member 121 can be moved in a set of directions 165 normal to the protruding direction 128 to contact a single point 163 in a primary squeegee direction. However, the linear squeegee 98 can only be moved in one direction 160 normal to the elongation direction 128 to contact a point 161 in a primary squeegee direction.

For descriptive purposes squeegees are classified as the following: squeegee segments have at least two terminus ends; continuous squeegees have no ends; and squeegee networks have squeegee walls that are shared by one or more adjacent squeegee enclosures or compartments. Squeegees can also have a single terminus end, wherein the squeegee forms and squeegee enclosure or compartment, but does not connect end-to-end.

Figure 3A:
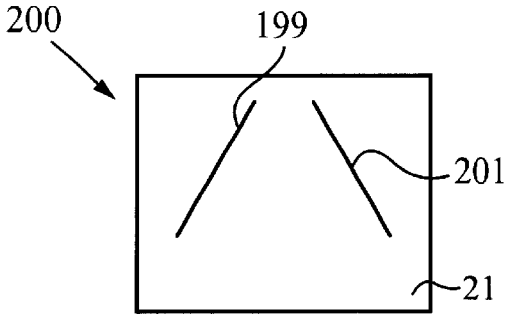
FIGS. 3*a–o* show a top perspective views of several squeegee configurations in accordance with the current invention.
Figure 3B:
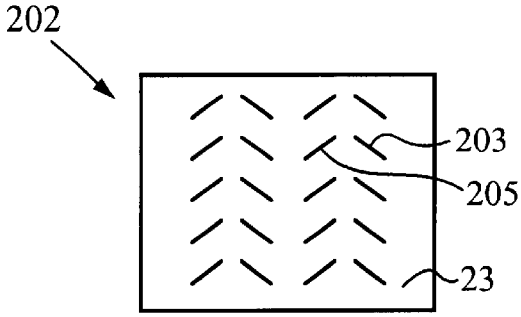
Figure 3C:
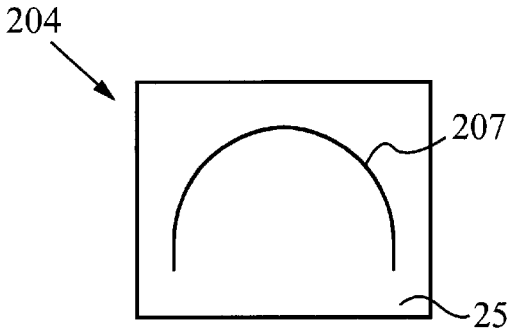
Figure 3D:
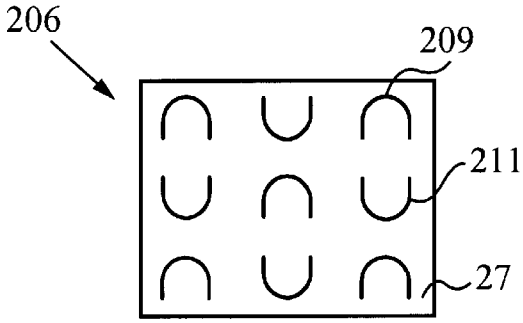
Figure 3E:
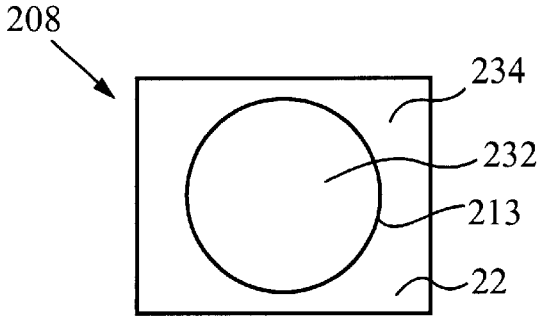
Figure 3F:
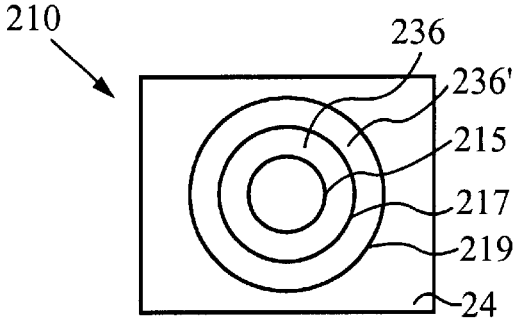
Figure 3G:
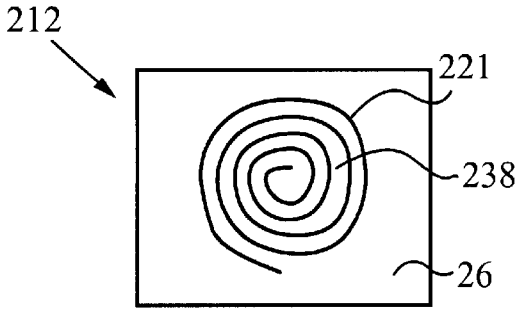
Figure 3H:
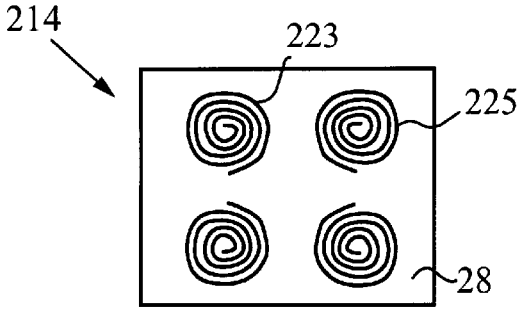
Figure 3I:
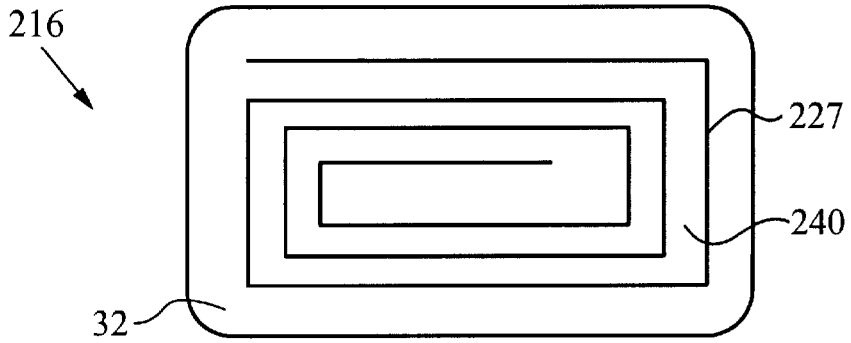
Figure 3J:
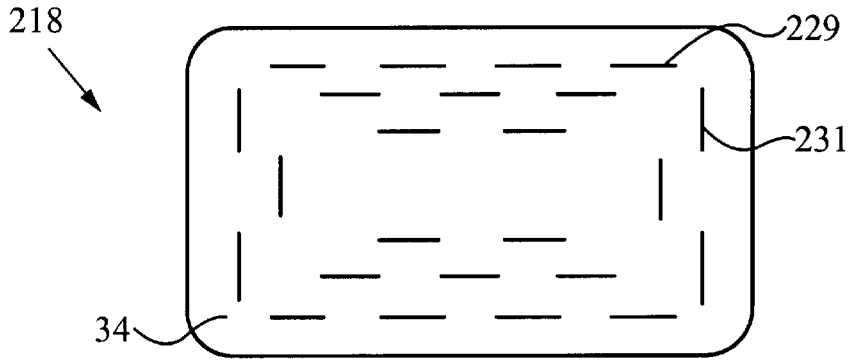
Figure 3K:
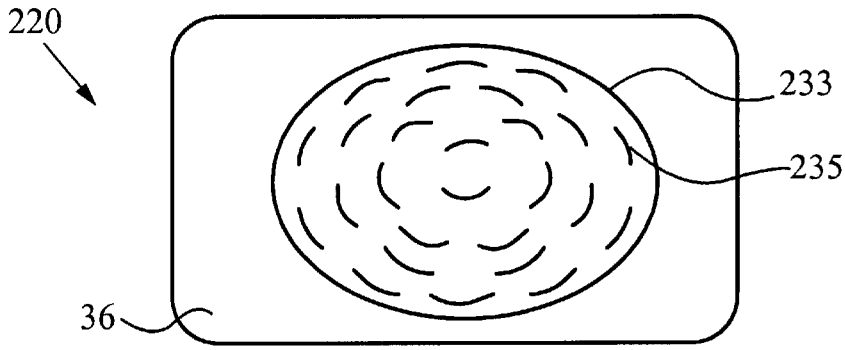
Figure 3L:
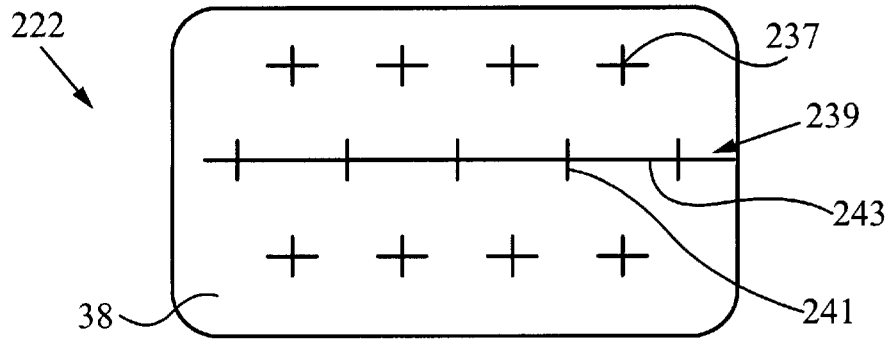
Figure 3M:
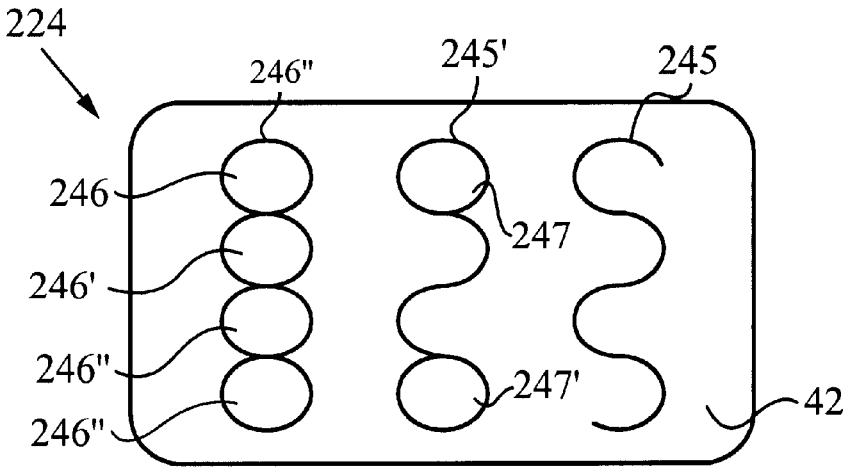
Figure 3N:
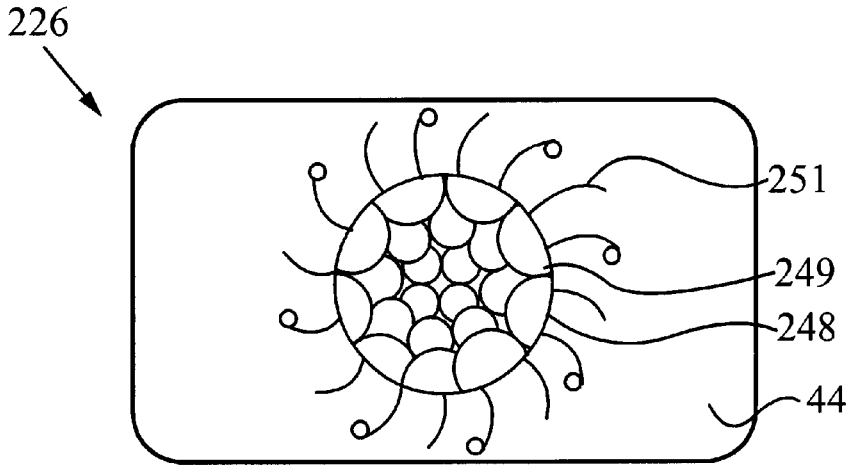
Figure 3O:
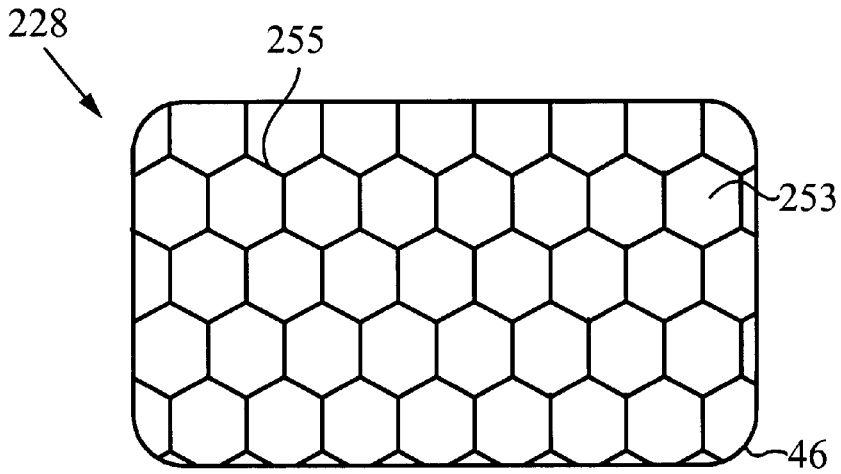

FIGS. 3*a–o* illustrate top perspective views of several alternative squeegee configurations that provide for a plurality of primary squeegee directions. FIG. 3*a* shows a squeegee configuration 200 with two elongated squeegee members 199/201 that protrude from a support member 21. Because the squeegee members 199/201 are positioned in an angled fashion, the squeegee configuration 200 provides for two primary squeegee directions that are substantially normal to the two corresponding elongation directions of the squeegee members 199 and 201. FIG. 3*b* shows a squeegee configurations 202 with a plurality of linear squeegee segment members 203/205 positioned at alternating angles and protruding from several positions of a support member 23. FIG. 3*c* illustrates a squeegee configuration 204 with a curved elongated squeegee member 207 that protrudes from a support member 25. The curved or cupped squeegee configuration 204 provides for primary squeegee directions all directions of a plane substantially containing the squeegee member 207 elongation directions. However, the squeegee configuration 204 does not provide for equal squeegee actions in all directions, because the squeegee member 207 will squeegee a surface twice each time the squeegee member 207 is moved with a sideways cleaning motion, but will squeegee a surface once for each up or down cleaning motion. Thus, the squeegee configuration 204 provides for a plurality of directionally dependent primary squeegee directions. FIG. 3*d* illustrates a squeegee configuration 206 with several cupped squeegee members 209/211 that protrude from a support member 27 with the squeegee members 209 and 211 cupped in opposite directions. FIG. 3*e* shows a squeegee configuration 208 with a continuous circular squeegee member 213 protruding from a support member 22. The continuous circular squeegee member 213 forms an inner squeegee region 232 and an outer squeegee region 234. Like the cupped squeegee configuration 204, the squeegee configuration 208 provides for primary squeegee directions in all directions of a plane substantially parallel to the elongation directions of the circular squeegee member 213. However, the circular squeegee configuration provides for a plurality of directionally independent primary squeegee directions. FIG. 3*f* illustrates a squeegee configuration 210 with several continues circular squeegee members 215, 217 and 219 protruding from a support member 24 that form a concentric set of squeegees with continuous circular channels 236 and 236'. The set of concentric continuous circular squeegee members provide for a plurality of primary squeegee directions in all directions of a plane substantially normal to the squeegee elongation directions. FIG. 3*g* shows a squeegee configuration 212 with a spiraling squeegee member 221 protruding from a squeegee support member 26. The spiraling squeegee member 221 forms a spiraling squeegee channel 238 and provides for a plurality of primary squeegee directions in all directions of a plane substantially normal to the squeegee elongation directions. FIG. 3*h* shows a squeegee configuration 214 with a plurality of spiraling squeegee members, such as 223 and 225 protruding from a squeegee support member 28 to provide a plurality of primary squeegee directions in all directions of a plane substantially normal to the squeegee elongation directions. FIG. 3*i* also shows a squeegee configuration 216 with a spiraling squeegee member 227 protruding from a squeegee support member 32. The squeegee member 227 spirals in a substantially rectangular fashion and forms a rectangular-like squeegee channel 240. The squeegee configuration 216 provides for directionally dependent squeegee action, wherein a diagonal cleaning motion will give a different squeegee action than a sideways or up and down cleaning motion. FIG. 3*j* and FIG. 3*k* illustrate squeegee configurations 218 and 220 that have squeegee segments protruding from squeegee support members 34 and 36, respectively, where the squeegee segments are positioned at varying angles on the squeegee support members 34/36. FIG. 3*j* shows linear squeegee segments 229 and 231 positioned at or near to right angles relative to each other and forming a rectangular segmented squeegee configuration 218. FIG. 3*k* shows squeegee configuration 220 comprising squeegee segments 235 that are positioned within an inner squeegee region of a larger circular squeegee member 233. FIG. 3*l* and FIG. 3*m* illustrate yet other squeegee configurations 222 and 224 that have squeegee members protruding from squeegee support members 38 and 42. In FIG. 3*l* the squeegee configuration 222 has cross-type squeegee segments 237. The squeegee configuration 222 can also have a major squeegee member 239, wherein the major squeegee member 239 comprises a long squeegee segment 243 intersected short squeegee segments 241 that are positioned at near to right angles relative to the long squeegee segment 243. The squeegee configuration 224 of FIG. 3*m* has a squiggling squeegee member 245 protruding from a squeegee support member 42 to provide several primary squeegee directions. Portions of squiggling squeegee member 245' is configured to enclose inner squeegee regions 247 and 247'. Squiggling squeegee 245" is configured to form a set of connected squeegee compartments 246, 246', 246" and 246"'. In FIG. 3*n* and FIG. 3*o*, squeegees are configured to produce a variety of squeegee compartments. The squeegee configuration 226 illustrates a complex arrangement of squeegees that form scale-shaped squeegee compartments 249 within a circular squeegee 248 and with squeegees flaring out 251 from the circular squeegee 248 to add other cleaning features. The configuration 228 illustrates a continues network of squeegee walls 255 that protrude from the support 46 and that forms an array of symmetrical squeegee compartments 253.

Figure 4A:
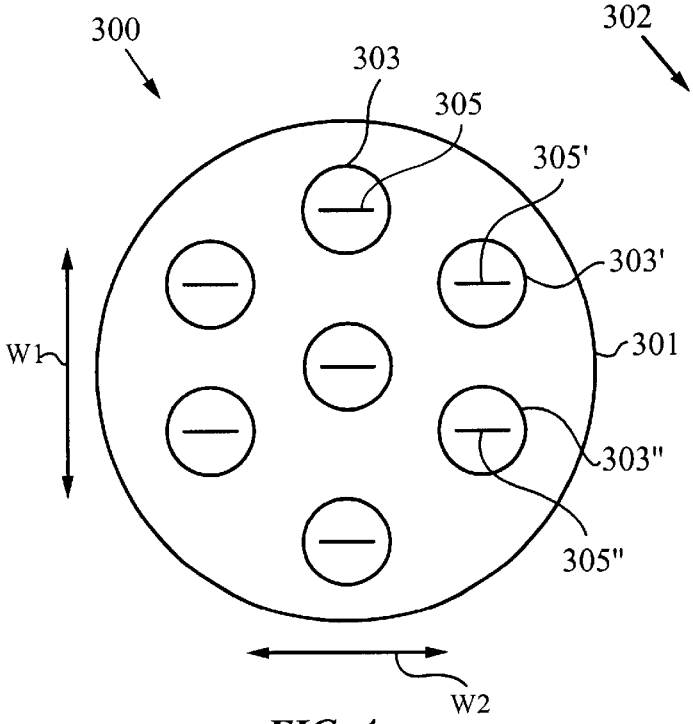
FIGS. 4*a–d* show several top perspective views of squeegee configurations that have directionally dependent squeegee cleaning action.
Figure 4B:
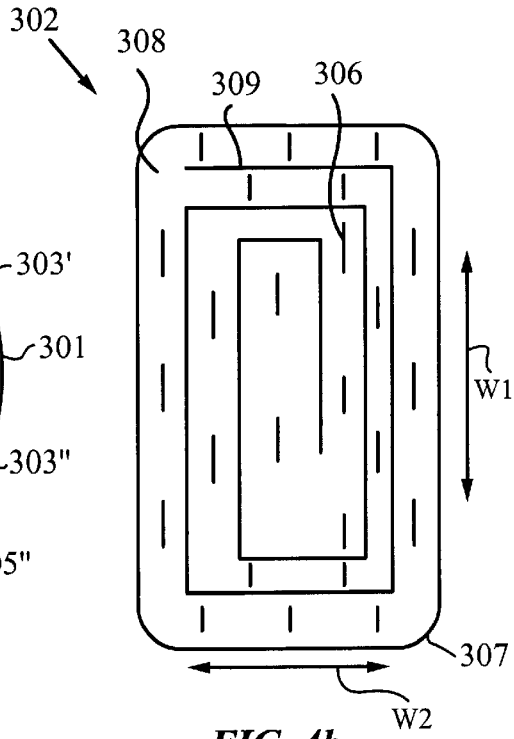
Figure 4C:
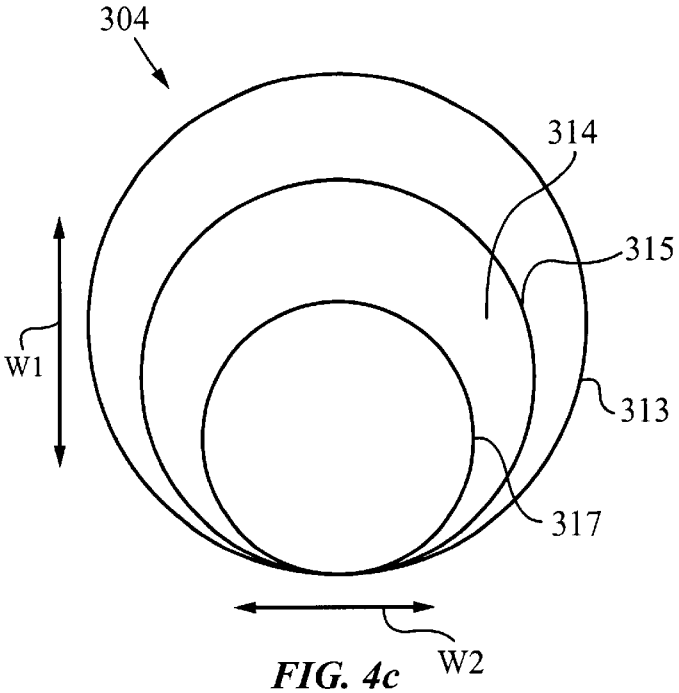
Figure 4D:
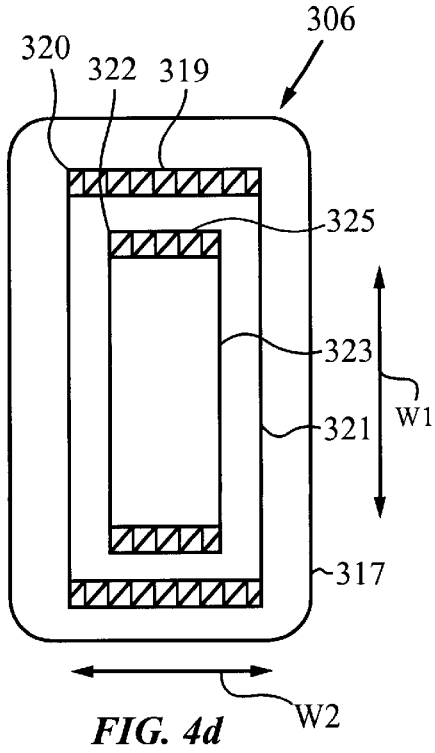

FIGS. 4*a–d* illustrate several squeegee configurations that provide for directionally dependent squeegee action. FIG. 4*a* shows a squeegee configuration 300 with several circular squeegee members 303, 303'and 303" protruding from a circular squeegee support member 301. Within the inner squeegee region of the circular squeegee members 303, 303' and 303" are linear squeegee segments 305, 305' and 305", respectively. The linear squeegee segments 305, 305' and 305" only provide for primary squeegee actions when the squeegee configuration 300 is moved on a surface with an upward or a downward cleaning motion, as indicated by the arrow W1. The linear squeegee segments 305, 305' and 305" do not, however, provide primary squeegee actions when the squeegee configuration 300 is moved on the surface with a sideways cleaning motion, as indicated by the arrow W2. FIG. 4*b* illustrates an alternative squeegee configuration 302 that provides for directionally dependent primary squeegee action. Linear squeegee segments 306 are positioned in the squeegee channel 308 of a spiraling rectangular squeegee member 309. The squeegee segments 306 and the spiraling squeegee 309 protrude from a squeegee support member 307. In this example, the linear segments 306 provide for primary squeegee actions when the squeegee configuration 302 is moved on a surface with a sideways cleaning motion, as indicated by the arrow W2, but do provide for primary squeegee action when the squeegee configuration 302 is moved on the surface with an upward or a downward cleaning motion, as indicated by the arrow W1. FIG. 4*c* shows a squeegee configuration 304 with two non-concentrically positioned circular squeegee members 315 and 317 protruding from a circular squeegee support member 313. In the squeegee configuration 304, it is the non-uniform channel spacing 314 between the squeegee members 315 and 317 that provides for directionally dependent primary squeegee actions, wherein the number of squeegees edges that contact a surface by moving the squeegee configuration 304 in with a sideways cleaning motion, as indicated by the arrow W2, is different that the number of squeegee edges that contact the surface by moving the squeegee configuration 304 in a sideways cleaning motion, as indicated by the arrow W2. FIG. 4*d* shows a different squeegee configuration 306 that provides for directionally dependent squeegee action. The squeegee configuration 306 comprises two rectangular squeegee members 320 and 322. The longer squeegee walls 321 and 323 of the rectangular squeegees, 320 and 322, are thinner than the shorter squeegee walls, 319 and 325. In this way the primary squeegee action is made to be different by virtue of alternating squeegee wall thicknesses or physical properties of the squeegees 320 and 322. In this embodiment, the thicker squeegees 319 and 325 exhibit primary squeegee action by moving the squeegee configuration 306 in an upward or downward cleaning motion, as indicated by the arrow W1, but do not provide for primary cleaning action when the squeegee configuration 306 is moved in with a sideways cleaning motion, as indicated by the arrow W2. It will be clear to one skilled in the art that there are many alternative squeegee configurations that can provide for directionally dependent squeegee actions. These variations can be achieved by varying squeegee geometries, squeegee configurations, squeegee thickness, squeegee materials and combinations thereof.

Figure 5A:
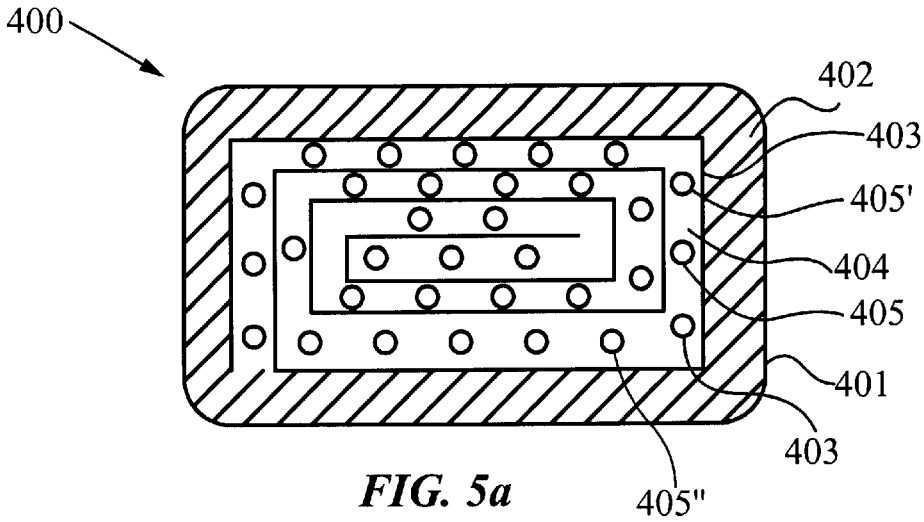
FIGS. 5*a–d* show several squeegee configurations with bristle sections incorporated.
Figure 5B:
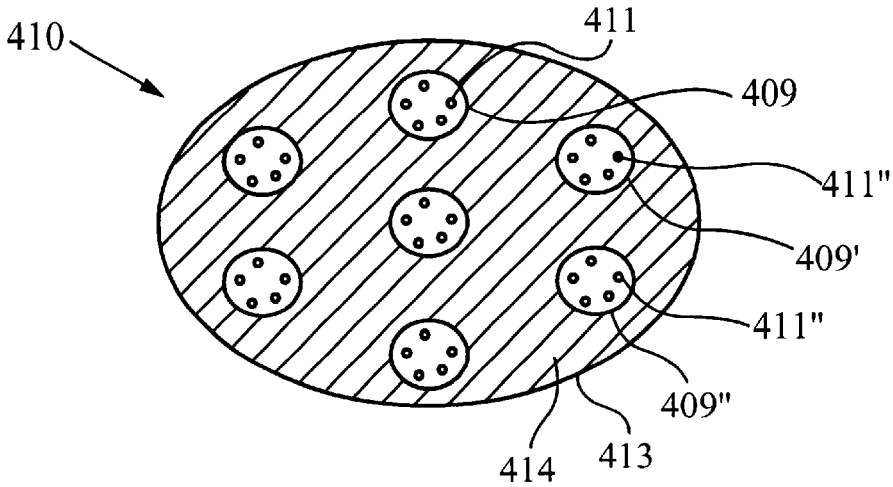
Figure 5C:
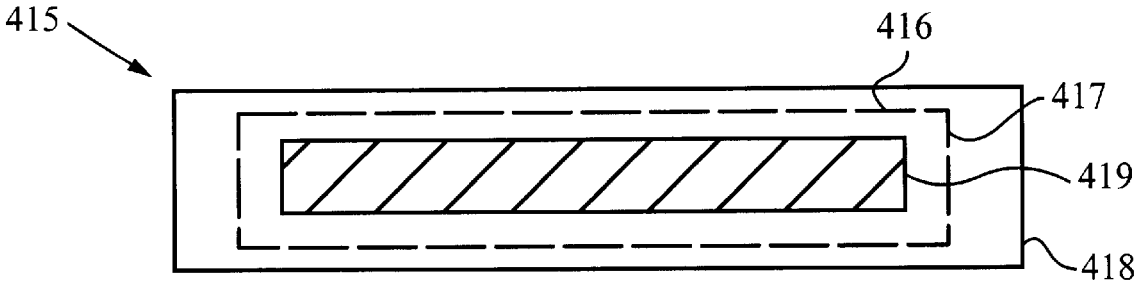
Figure 5D:
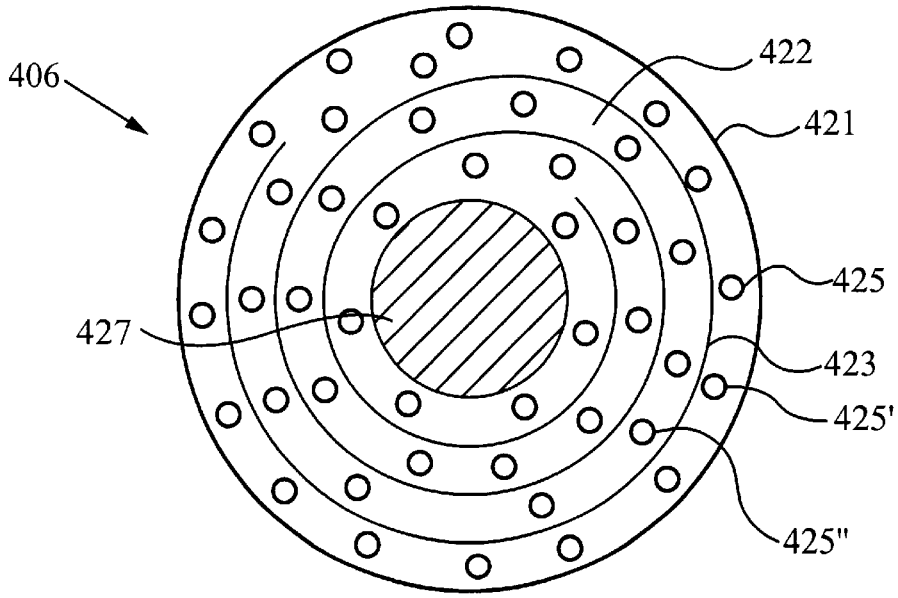

FIGS. 5*a–d* show top views of several dentition cleaning heads configured with squeegee sections and bristles. FIG. 5*a* shows a substantially rectangular cleaning head portion 400 with a spiraling rectangular squeegee 403 protruding from a rectangular support member 401. In the rectangular-like squeegee channel 404 there are several brush sections such as 405, 405' and 405" protruding from the surface 402. FIG. 5*b* illustrates an oval cleaning head configuration 410 with circular squeegee members 409, 409' and 409" protruding from the surface 414 of a circular support member 413. Within the inner squeegee region of the circular squeegee members 409, 409' and 409" there are bristles sections 411, 411' and 411". FIG. 5*c* shows an elongated cleaning head configuration 415 comprising squeegee segments such as 416 and 417 protruding from a rectangular support member 418 and forming a segmented rectangular squeegee configuration. Within the segmented rectangular squeegee configuration, there is a substantially rectangular brush section 419 protruding from the support member 415. FIG. 5*d* illustrates a cleaning head configuration 420 with a spiraling squeegee member 423 protruding from a circular support member 421 and forming a spiral channel 422. There are several medium ports 425, 425' and 425" positioned within the spiraling channel 422. The medium ports 425, 425' and 425" provide a means for directing a medium to dentition surfaces during cleaning or alternately for drawing a vacuum near a surface of dentition. The cleaning configuration 420 further includes a brush section 427 attached substantially central to the support member 421. The configuration 420 is particularly useful where a cleaning medium such water is required or where vacuum convection is needed to remove cleaning solutions, saliva and the like. The cleaning configuration 420 can also be configured to attached to a rotary device to provide a rotary cleaning action to the surfaces of dentition during a cleaning operation. It is clear that any of the cleaning head configurations described herein are adaptable to have ports or apertures through which oral cleaning solutions can be delivered or through which a vacuum can be drawn to facilitate cleaning of dentition.

Figure 6A:
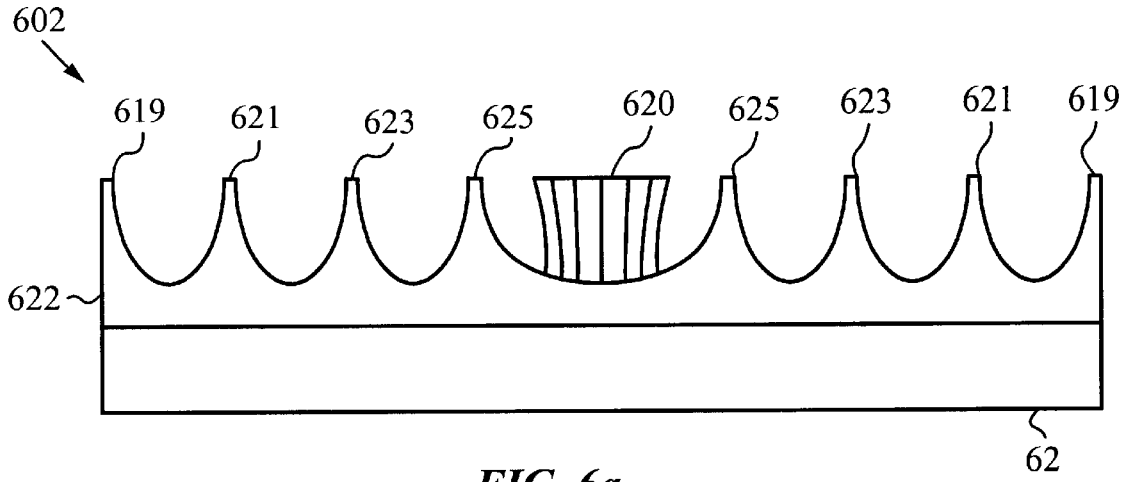
FIGS. 6*a–d* show cross-sectional view of squeegees with continuous squeegees walls protruding from a single squeegee member.
Figure 6B:
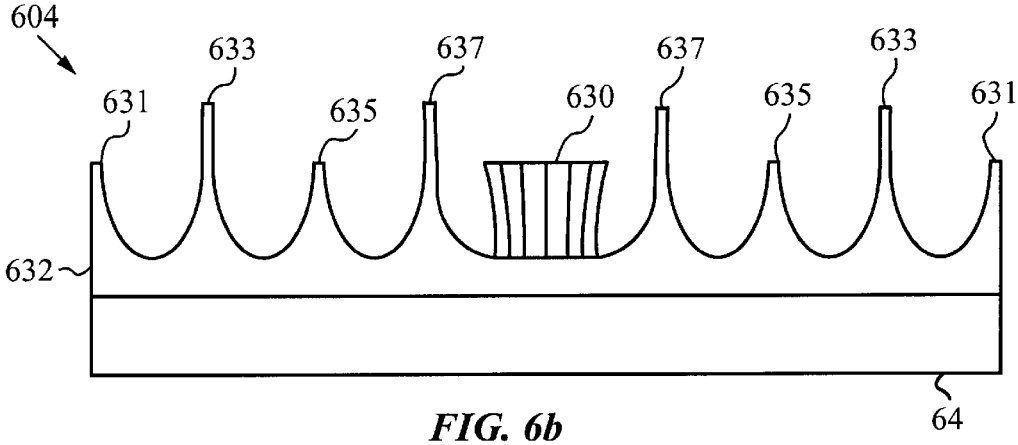
Figure 6C:
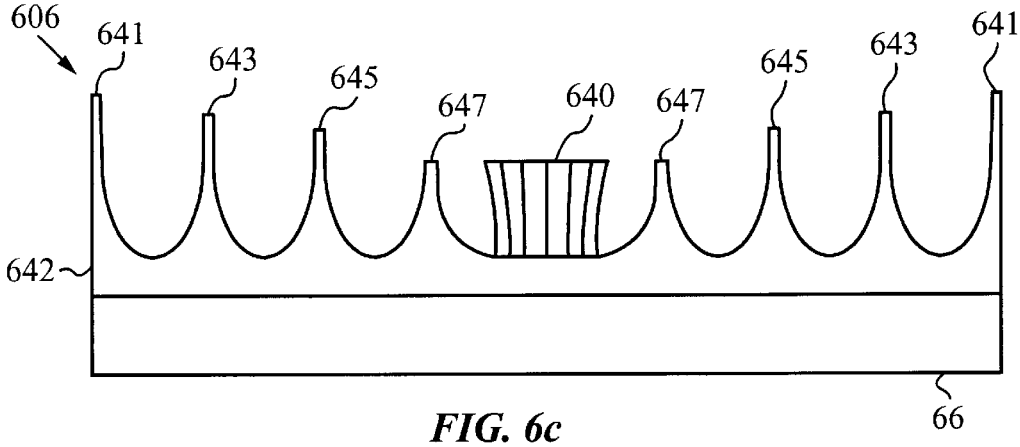
Figure 6D:
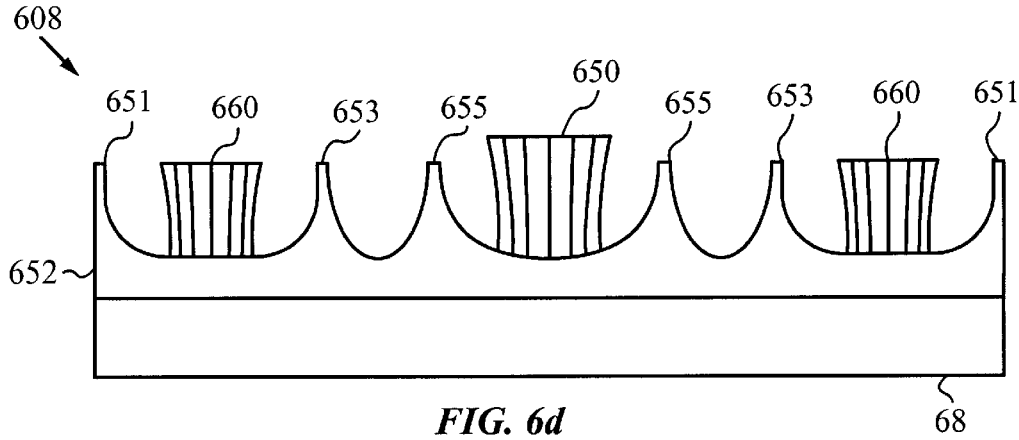

FIGS. 6*a–d* show cross-sectional views of several dentition cleaning head configurations with a squeegee member having continuous elongated squeegees. FIG. 6*a* shows a cross-sectional view of a dentition cleaning head 602 with a squeegee member 622 attached to a support 62. The squeegee member has four substantially circular protruding squeegee edges 619, 621, 623 and 625. Positioned substantially in the center of the squeegee member 622, is a brush section 620. FIG. 6*b* shows cross-sectional view of a dentition cleaning head 604 with a squeegee member 632 attached to a support 64. The squeegee member 632 has four substantially circular protruding squeegee edges 631, 633, 635 and 637. The protruding squeegee edges protrude in an alternating fashion with the cleaning edges of squeegees 633 and 637 protruding farther than the cleaning edges of squeegee 631 and 635. Positioned substantially in the center of the squeegee member 632 is a brush section 630. FIG. 6*c* shows cross-sectional view of a dentition cleaning head 606 with a squeegee member 642 attached to a support 66. The squeegee member 642 has four continuous protruding squeegees 641, 643, 645 and 647. The cleaning edges of the squeegees 641, 643, 645 and 647 protrude in a cascade fashion with the edge of squeegee 641 protruding farthest and the edge of squeegee 647 protruding the least. Positioned substantially in the center of the squeegee member 642 is a brush section 640. FIG. 6*d* shows a cross-sectional view of a dentition cleaning head 608 with a squeegee member 652 attached to a support 68. The squeegee member 652 has three continuous protruding squeegee edges 651, 653, and 655. The edges of the squeegees edges 651, 653, and 655 are spatially displaced such that the distance between the squeegees 651 and 653 is greater than the distance between the squeegees 653 and 655. The dentition cleaning head configuration 608 has two brush section 650 and 660. The brush section 650 is positioned substantially in the center squeegee member 652 while the brush section 660 is a continuous brush section that positioned in the squeegee channel defined by protruding squeegees 651 and 653.

All of the dentition cleaning heads detailed and described, herein can be configured to have bristles or bristle sections integrated into the cleaning head, attached to the squeegee members themselves or attached to another portion of the cleaning device. For some applications of the invention the combination of a squeegee or squeegees and bristles is preferred. In one embodiment of the invention a squeegee section encircle bristle sections or portions thereof to reduce potential contact of the bristles with soft gum tissue while messaging the gums during cleaning of the teeth.

Figure 7A:
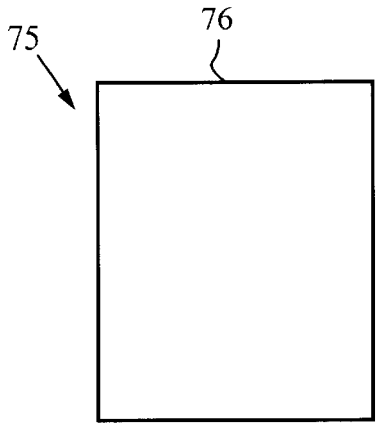
FIGS. 7*a–f* show several squeegee segments with contoured cleaning edges used in the dentition cleaning system and device of the current invention.
Figure 7B:
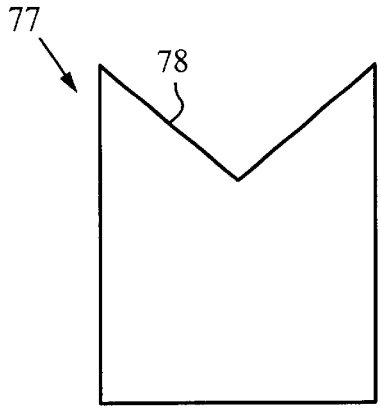
Figure 7C:
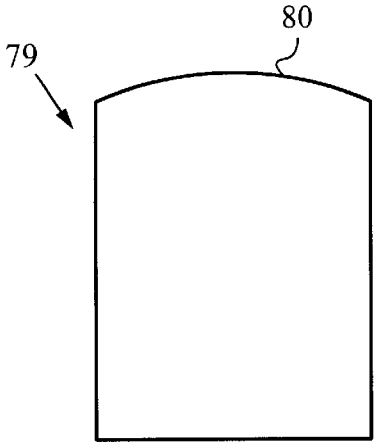
Figure 7D:
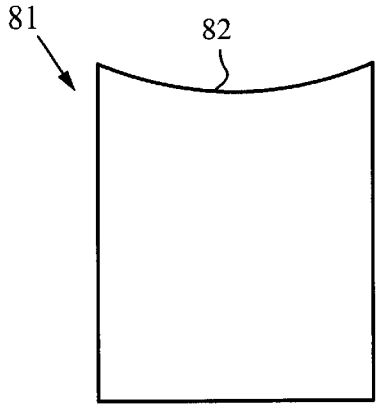
Figure 7E:
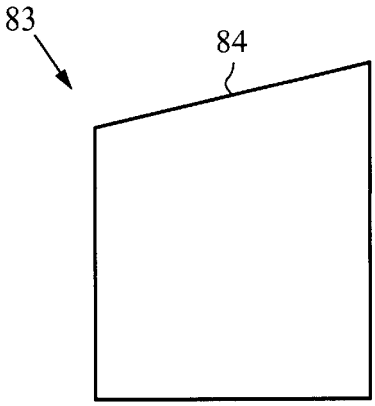
Figure 7F:
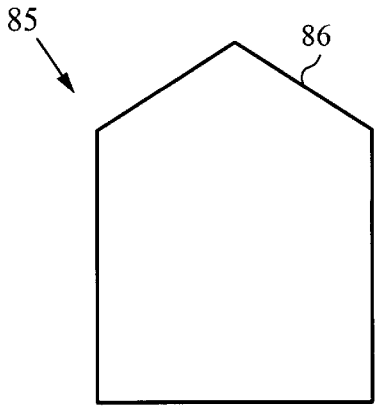

FIGS. 7*a–f* illustrate squeegee segments with contoured squeegee cleaning edges that are useful in the dentition cleaning device and system of the current invention. FIG. 7*a* shows a squeegee segment 75 with a planar protruding edge 76. FIG. 7*b* illustrates a squeegee segment 77 with a V-shaped cleaning edge 78; FIG. 7*c* illustrates a squeegee segment 79 with a curved, convex contoured cleaning edge 80; FIG. 7*d* shows a squeegee segment 81 with a concave contoured squeegee edge 82; FIG. 7*e* shows a squeegee segment 83 with a diagonally contoured cleaning edge 84; and FIG. 7f shows a squeegee segment 85 with a pointed cleaning edge 86.

Figure 8A:
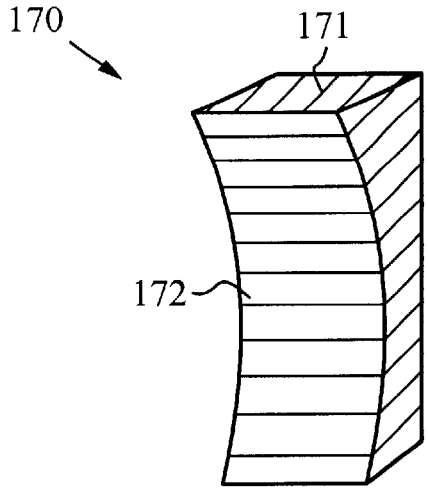
FIGS. 8*a–f* show several squeegee segments with contoured or modified squeegee walls used in the dentition cleaning system and device of the current invention.
Figure 8B:
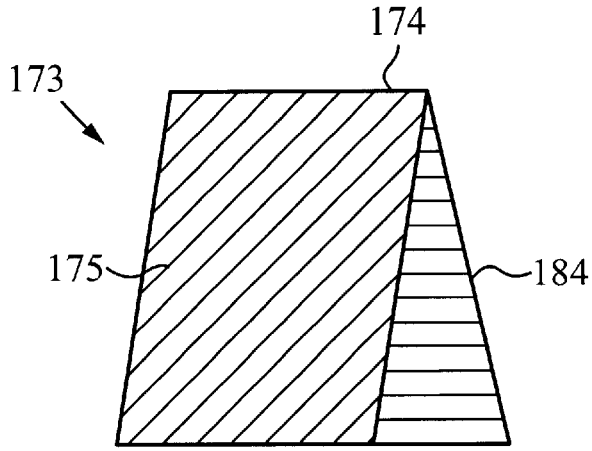
Figure 8C:
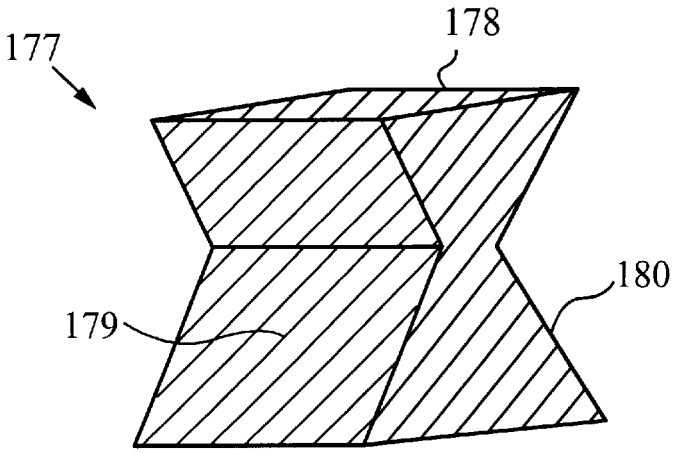
Figure 8D:
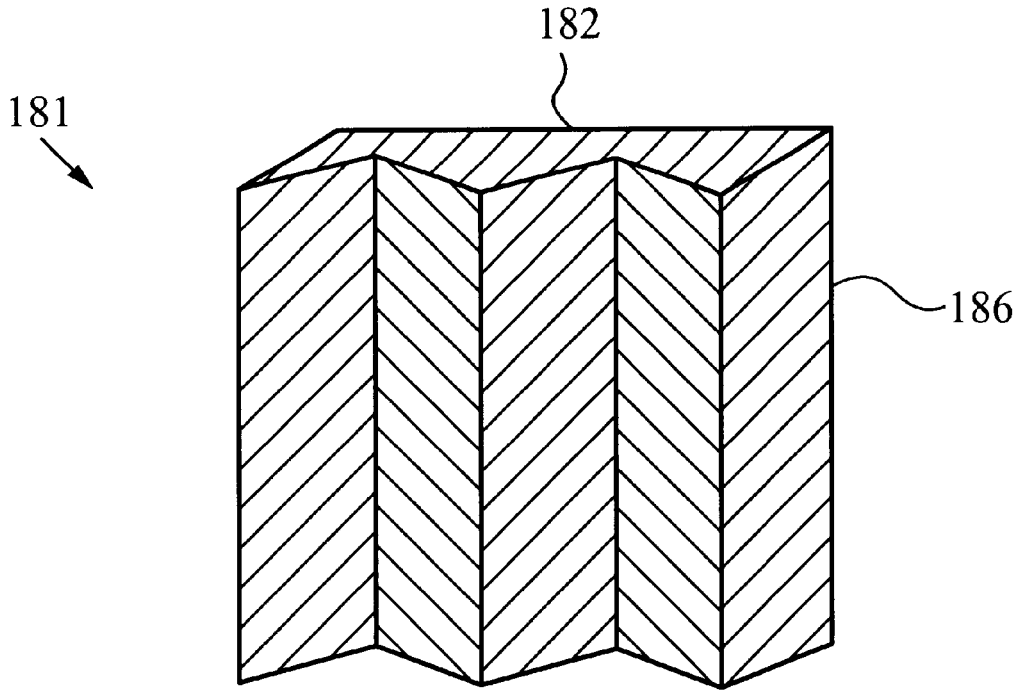
Figure 8E:
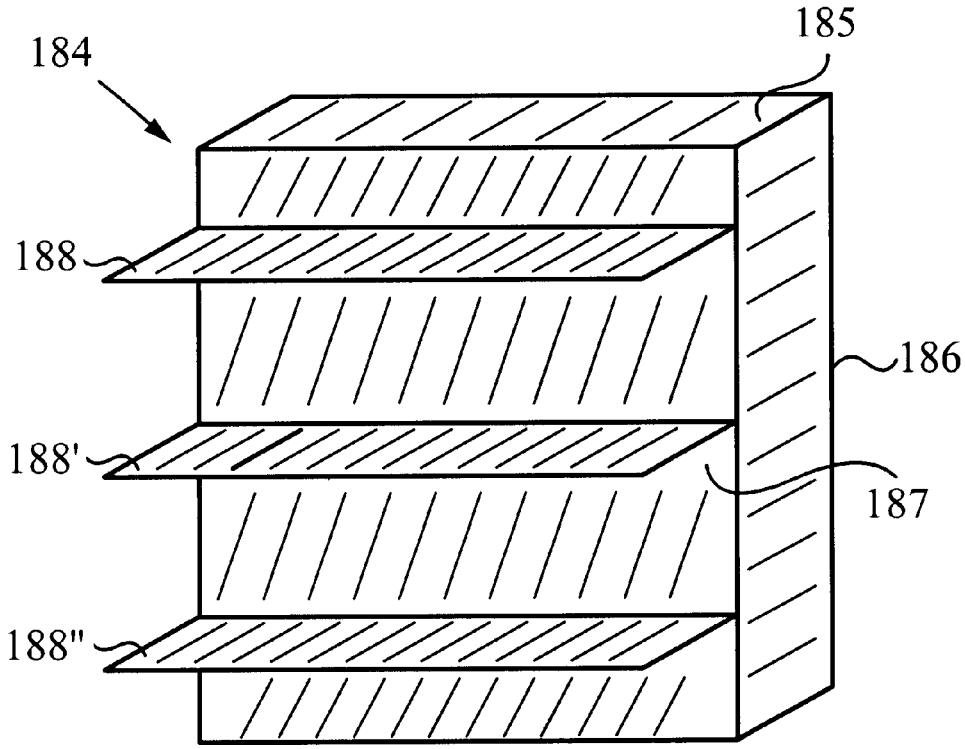
Figure 8F:
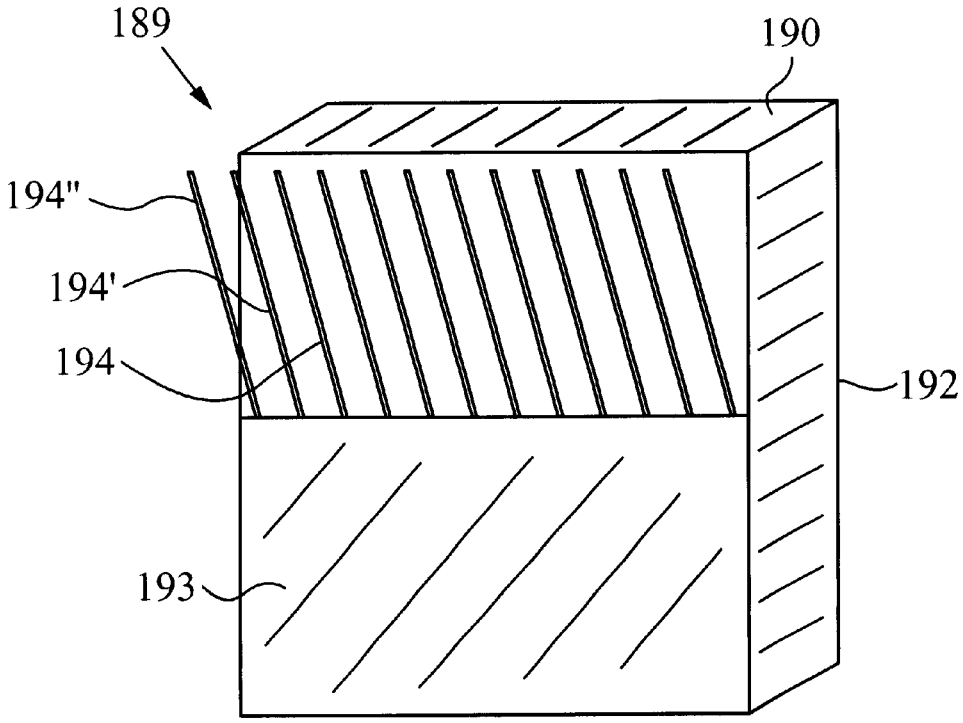

FIGS. 8*a–f* illustrate several squeegee segments with contoured squeegee walls. FIG. 8*a* illustrates a squeegee segment 170 with a planar protruding edge 171 and a concave squeegee wall 172; FIG. 8*b* illustrates a squeegee segment 173 with a planar pointed protruding edge 174 and tapered squeegee walls 175/184; FIG. 8*c* illustrates a squeegee segment 177 with a planar protruding edge 178 and concave V-shaped squeegee walls 179/180; FIG. 8*d* illustrates a squeegee segment 181 with a jagged protruding edge 182 and a grooved squeegee wall 183 grooved in the squeegee protruding direction; FIG. 8*e* illustrates a squeegee segment 184 with a planar cleaning edge 185 and walls 186/187, with smaller squeegees 188, 188' and 188" attached to the wall 187; and FIG. 8*f* shows a squeegee segment 189 with a planar cleaning edge 190 and planar squeegee walls 192/193 with bristles 194, 194' and 194" attached to and protruding from the squeegee wall 193.

Figure 9A:
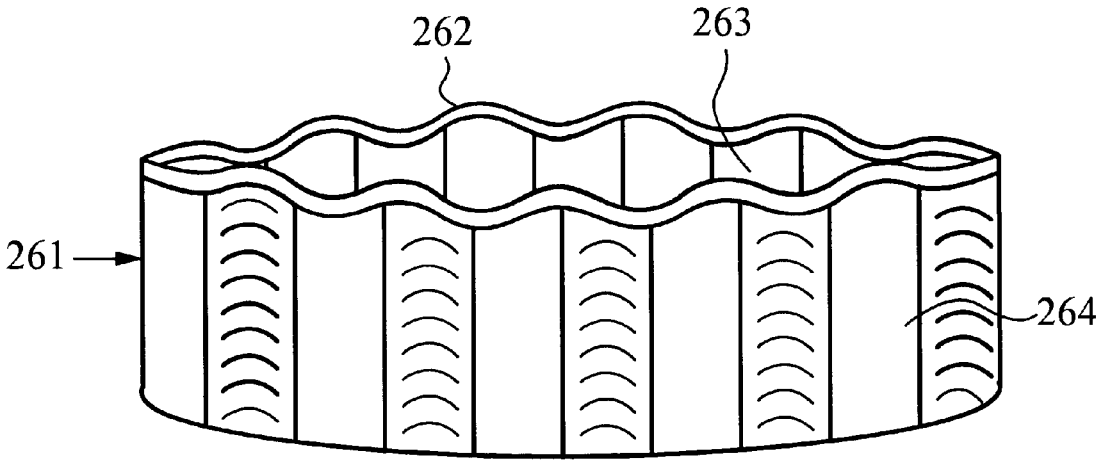
FIGS. 9*a–b* illustrate a perspective view and a top perspective view of a continuous squeegee member with contoured squeegee walls and a contoured squeegee cleaning edge.
Figure 9B:
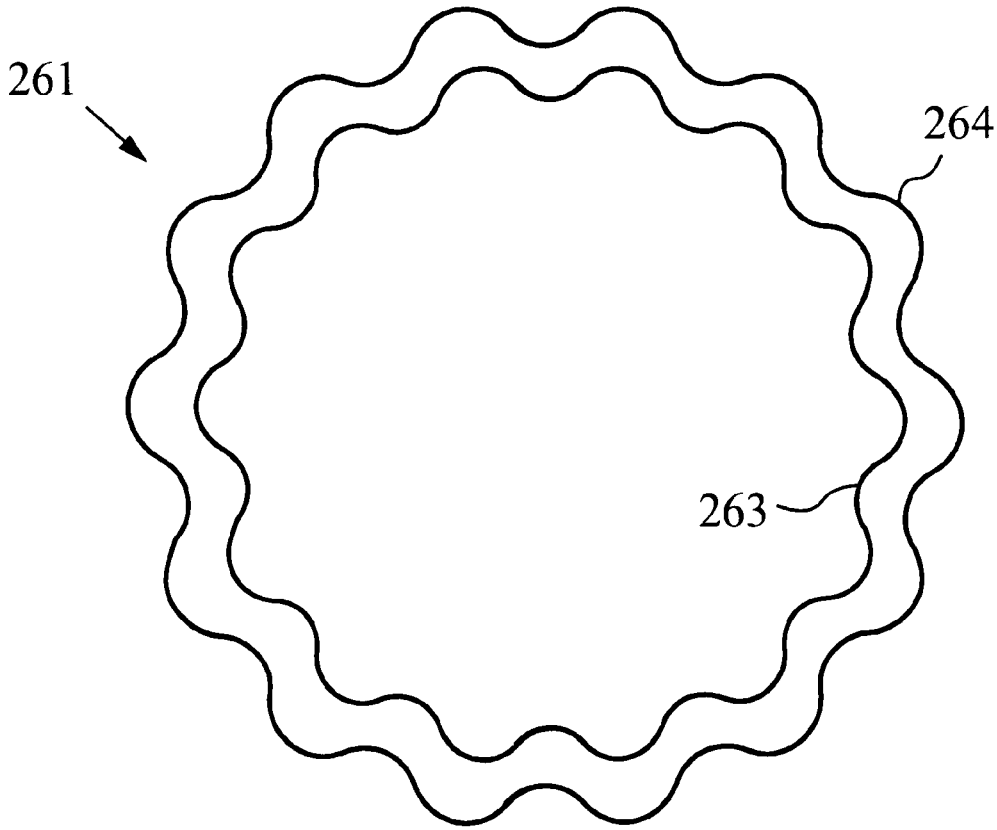

FIGS. 9*a–b* show a continuous squeegee with a contoured squeegee cleaning edge and contoured squeegee walls. FIG. 9*a* shows a perspective view of a substantially circular squeegee member 261 with a contoured protruding squeegee edge 262 and a contoured squeegee wall 263/264. The squeegee cleaning edged 262 and the squeegee walls 263/264 are contoured in a corrugated wave-like fashion. FIG. 9*b* shows a top view of the squeegee member 261 illustrating the corrugated wave-like contouring of the squeegee member walls 263/264.

Figure 10:
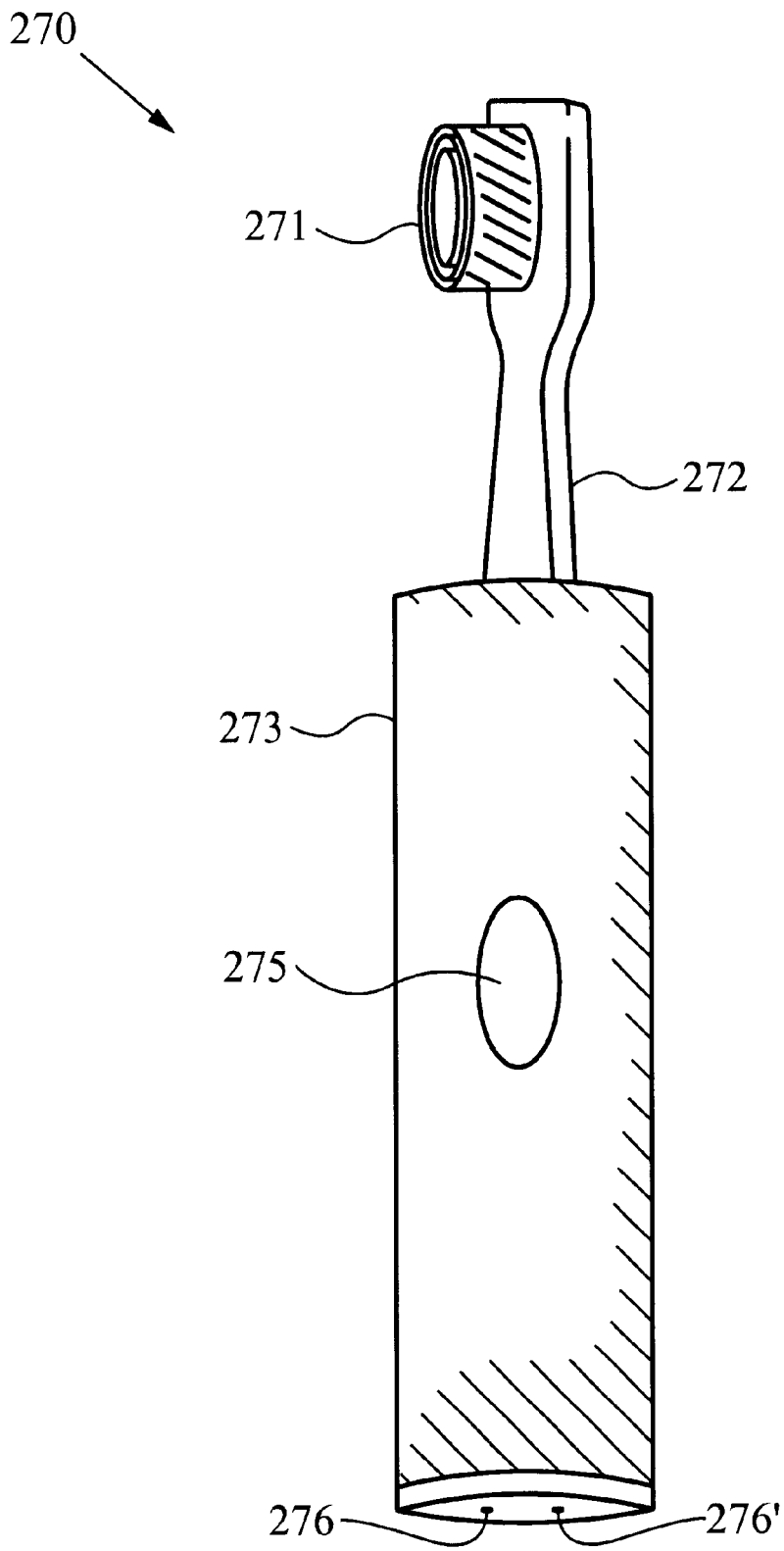
FIG. 10 illustrates a motorized rechargeable dentition cleaning device in accordance with the current invention.

FIG. 10 illustrates an electric dentition cleaning device 270 that utilizes a dentition squeegee cleaning head 271 according with a preferred embodiment of the invention. The dentition cleaning head 271 several continuous squeegee members positioned in a substantially concentric fashion wherein smaller squeegee members are positioned within the next larger squeegee element as shown. The dentition cleaning head 271 is attached to a body 272. The body 272 is attached to a motorized handle 273 that provides agitation to the cleaning head 271 through the body 272. The motorized handle 273 is preferably capable of being turned on and off through the switch 275 and is powered by an internal battery (not shown) that is rechargeable through the contacts 276 and 276' with a properly configured battery charger (also not shown).

Figure 11A:
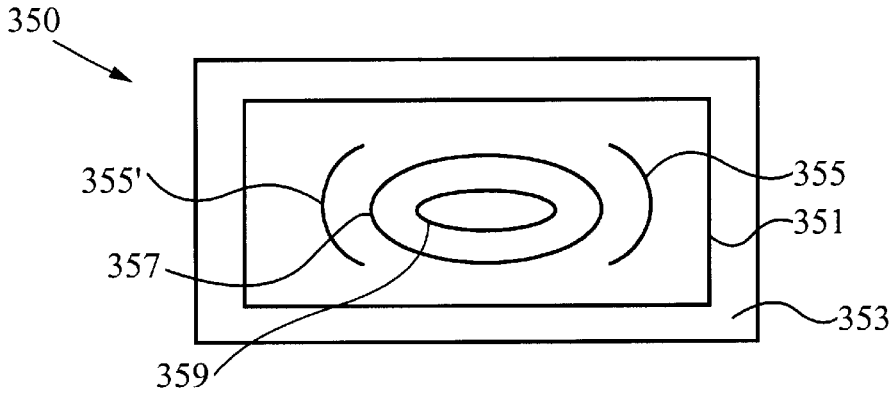
FIGS. 11*a–d* show perspective views of a dentition cleaning head according to a preferred embodiment of the current invention.
Figure 11B:
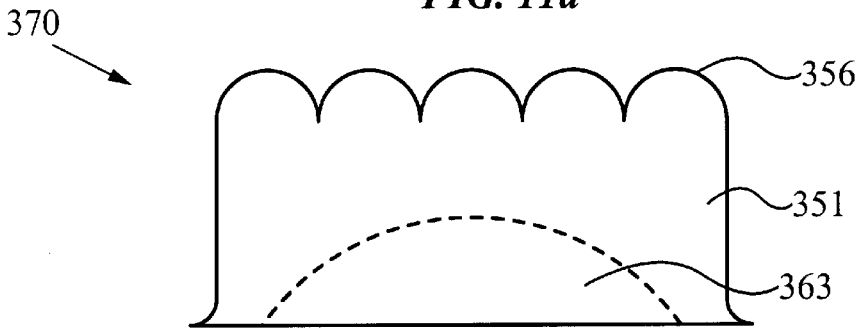
Figure 11C:
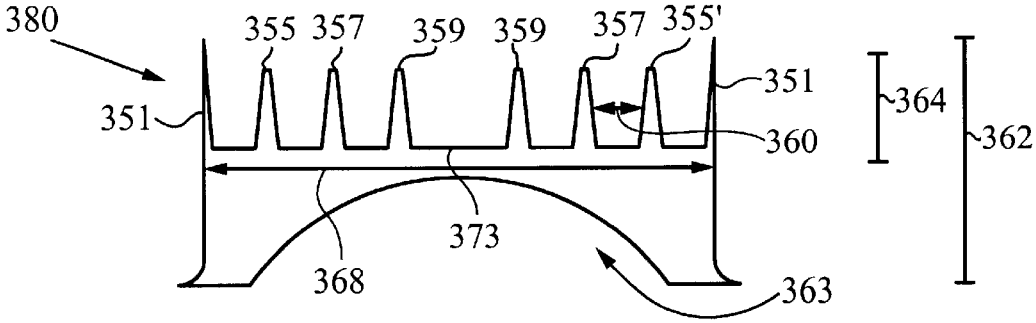
Figure 11D:
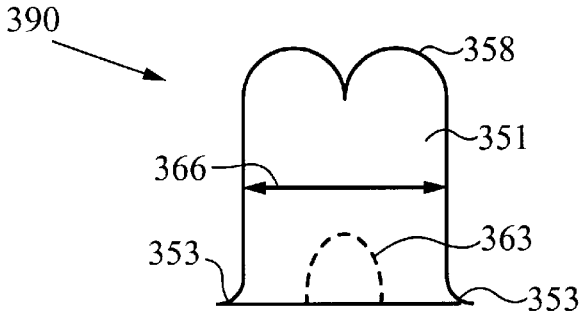

FIGS. 11*a–d* illustrate several views of a dentition cleaning head configured according to a preferred embodiment of the current invention. FIG. 11*a* shows a top view of a dentition cleaning head 350. The dentition cleaning head has a base portion 353, a continuous outer squeegee member 351, two curved squeegee segments 355/355', and two oval squeegee members 357/359 with the smaller squeegee member 359 positioned concentrically within the inner squeegee region of the larger squeegee member 357. FIG. 11*b* illustrates a side view 370 of the squeegee cleaning head 350. The outer squeegee member 351 preferably extends farther from the base 353 than the inner squeegee members 355, 355', 357, and 359 and has a squeegee cleaning edge 356 that is contoured as shown. The contoured squeegee cleaning edge 356 facilitates the ability of the squeegee 351 to penetrate grooves of teeth and spaces between teeth. Further, its is believed that a contoured squeegee cleaning edge 356 will facilitate the ability of the squeegee 351 to penetrates spaces between the gum line and teeth during a cleaning operation. The cleaning head 350 may also have a cavity 363 to increase the flexibility of the dentition cleaning head 350. FIG. 11*c* illustrates a cross sectional view 380 of the cleaning head 350 shown in FIG. 11*a*. All of the squeegee members 351, 355, 355', 357 and 359 preferably have tapering wall thicknesses, being thicker near the surface 373 and thinner near the cleaning edges. The length of the dentition cleaning head 368 is preferably in a range of 1.0 to 4.0 cm. The outer squeegees squeegee member 351 preferably does not protrude a distance 362 father than 1.5 cm from the bottom of the base support 353 or a distance 364 more than 1.0 cm from the inner surface 373. The tops of the squeegee cleaning edges are preferably less than 0.5 mm in thickness and most preferably less than 0.2 mm. The average separation 360 between adjacent squeegee members is preferably in the range of 1.0 cm to 0.05 cm and most preferably between 0.3 and 0.1 cm. However, the preferred separation 360 will vary depending on the cleaning solution used. The average separation 360 is preferably chosen such that water or a liquid oral cleaner is retained in the squeegee channels of the dentition cleaning head 350 even when the dentition cleaning head 350 is inverted, but such that cleaning solutions and debris are easily rinsed away under running water. FIG. 11*d* shows an end view 390 of the dentition cleaning head 350. The width of the dentition cleaning head 366 is preferably in the range of 0.5 cm to 2.0 cm. Side squeegee edge 358 of the squeegee member 351 is also preferably contoured as shown. FIGS. 11*a–d* are set forth as an example of the preferred embodiment. It is clear that the dimensions of the dentition cleaning head 350 can altered in many ways depending on the application at hand. For example, larger devices are useful for providing oral care for other animals including horses and dogs, while smaller devices are useful for cleaning the gums and teeth of infants or small children.

Figure 12:
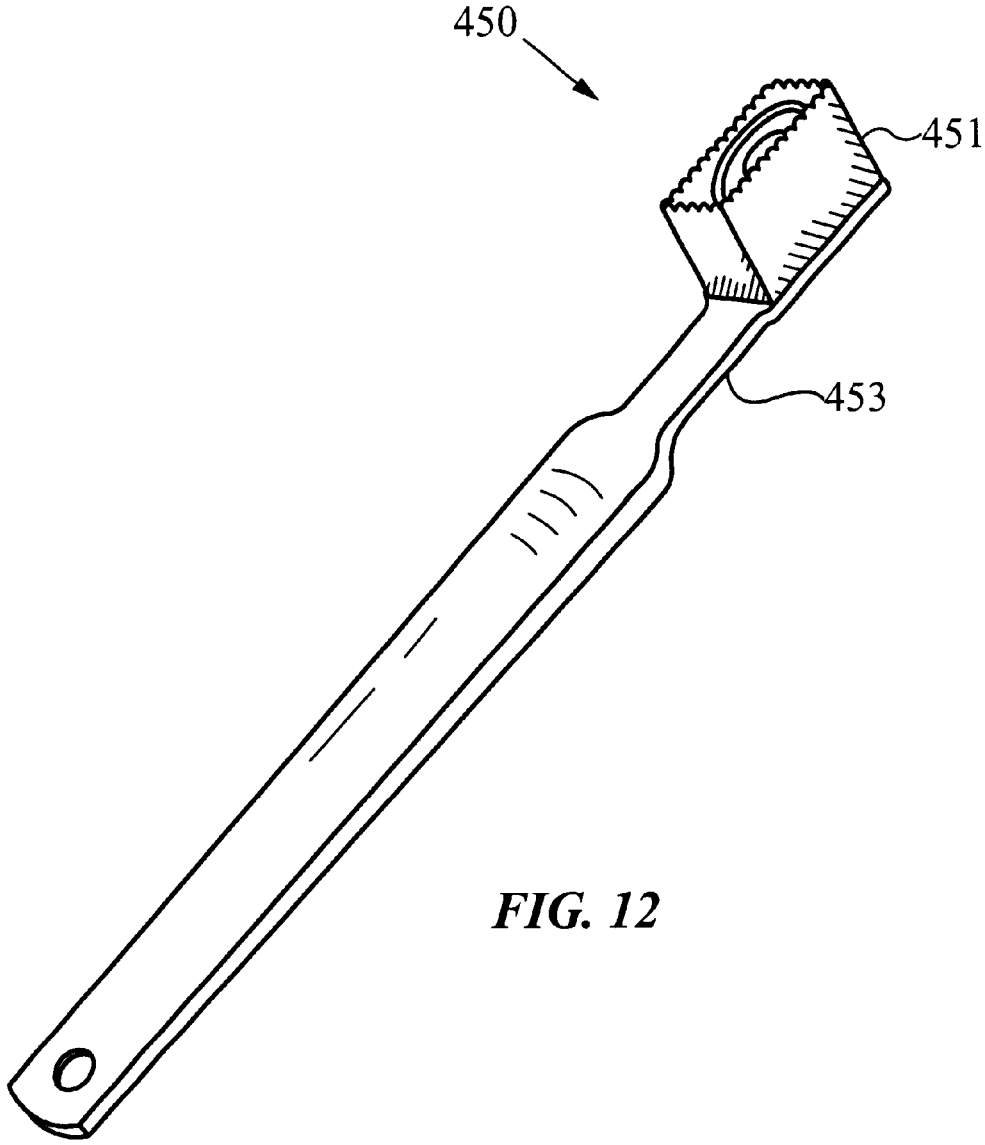
FIG. 12 illustrates a perspective view of a manual hand held dentition cleaning device according to a preferred embodiment of the present invention.

FIG. 12 illustrates a perspective view of a hand-held manual dentition cleaning device 450 configured with a cleaning head 451 similar to that described in FIGS. 11*a–d*. The dentition cleaning head 451 is preferably formed from soft flexible non-toxic material such as rubber, latex, silicon or polyurethane. The dentition cleaning head 451 is attached to a handle 453 by any suitable method known in the art, but is preferably co-molded to the handle during manufacturing of the device 450. Holes may be provided in the preformed plastic handle 453 prior to co-molding the dentition cleaning head 450 to the handle 453 to ensure that dentition cleaning head 451 remains secured to the handle 453. A second smaller dentition cleaning head may also be attached to the opposite side of the handle or the device may be equipped with a bristle section on the opposite end of the handle 453 or on the other side of the handle (not shown) to provide a multi-functional dentition cleaning device.

Figure 13A:
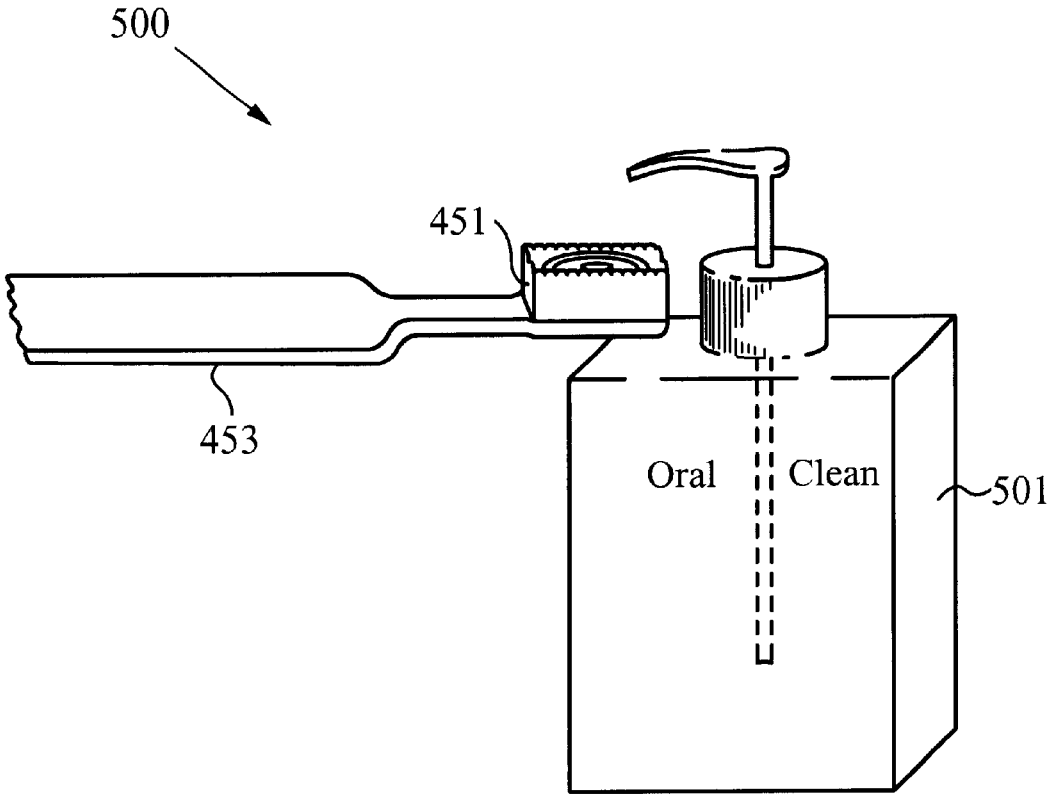
FIGS. 13*a–b* illustrate a dentition cleaning system with a hand held dentition cleaning device and a low viscosity dentition cleaning solution that is deliverable through a container equipped with a pump.
Figure 13B:
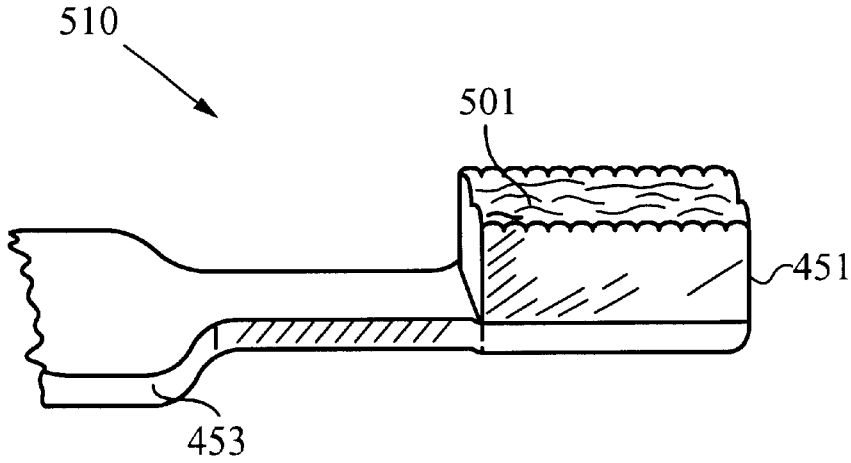

FIGS. 13*a–b* illustrate a cleaning system according to the present invention. FIG. 13*a* shows a perspective view 500 of the dentition cleaning device 450 described in FIG. 12 being prepared for a cleaning operation. Oral cleaning solution 501 is dispensed by a conventional pump device onto the cleaning head 451 with the cleaning head 451 in an upright position as shown. FIG. 13*b* shows a perspective view 510 of the oral cleaning device 450 having the oral cleaning solution 501 held within the squeegee cavity of the cleaning head 451. Because the cleaning head 451 provides a containing structure, the device 450 can be used with low viscosity oral cleaning solutions. Low viscosity oral cleaning solution have several advantages over conventional tooth pastes including being easier to clean from a sink and/or counter surfaces. Further, because low viscosity oral cleaning solutions can be dispensed from a conventional pump device, as shown, the solution can be sold in bulk and the container can be refilled, thus providing potential economic and environmental benefits. While the preferred system of the invention utilizes a low viscosity oral cleaning solutions, the dentition cleaning device 450 can be used with conventional tooth pastes known in the art.

Figure 14A:
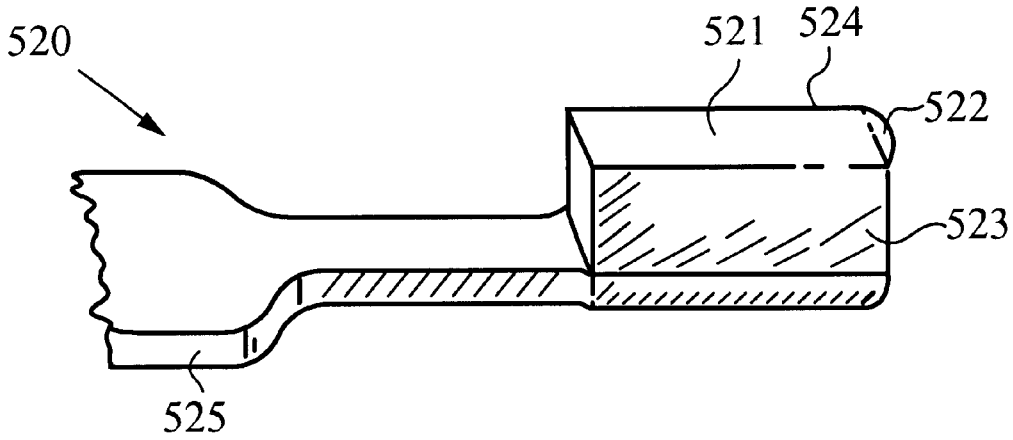
FIGS. 14*a–b* illustrate a dentition cleaning device with a removable seal according to an embodiment of the current invention.
Figure 14B:
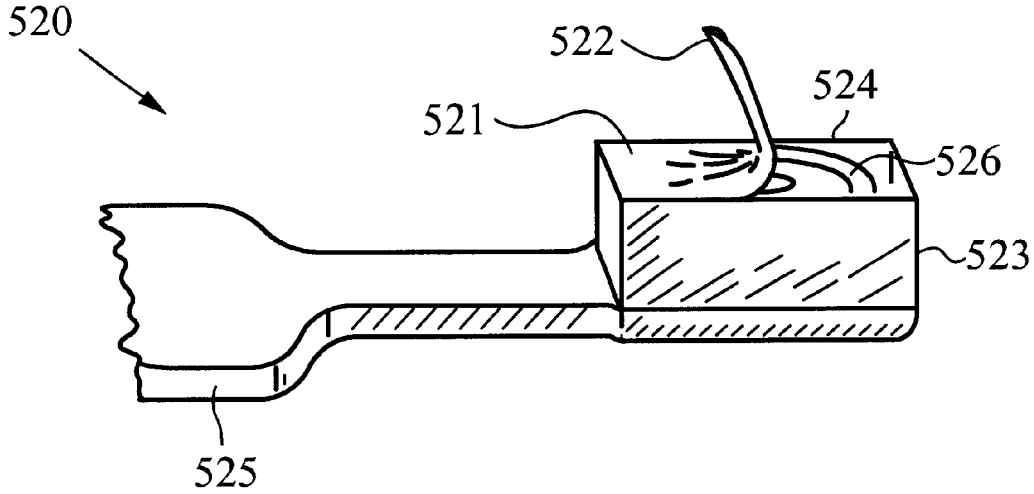

FIGS. 14*a–b* illustrate a dentition cleaning device that is similar to the device 450 shown in FIG. 12 which is further equipped with a removable cover 521. FIG. 14*a* shows a dentition cleaning device 520 with a cleaning head 523 that is configured with continuos outer squeegee. The inner portion of the cleaning head is sealed with a removable cover 521. Preferably, the inner portion of the cleaning head 523 is sealed with the cover 521 by a sticky adhesive that sticks to the edge 524 of the outer squeegee to hold the cover 521 in place. The cover 521 has a tab 522 that can be grabbed to remove the cover 521 from the cleaning head 523. The adhesive preferentially remains attached to the cover 521 when it is removed from the edge 524 of the outer squeegee. In FIG. 14*b*, the cover 521 is partially removed form the head 523 by pulling the tab 522 as shown. The cover 521 keeps the interior portion 526 of the head 523 sanitary during storage or while transporting the device 520. Prior to sealing the cover 521 on the head 523, cleaning substances, including liquids or powders, can be placed in the interior portion 526 of the head 523 and stored there until the device 520 is ready for use. This embodiment is particular useful for as travel dentition care kit. The device 520 can be made to be disposable after a single used or made to be reusable. Further, the cover 521 may be made to be resealed on the head 523 after use or the device 520 may be equipped with a more elaborate cover.

Figure 15A:
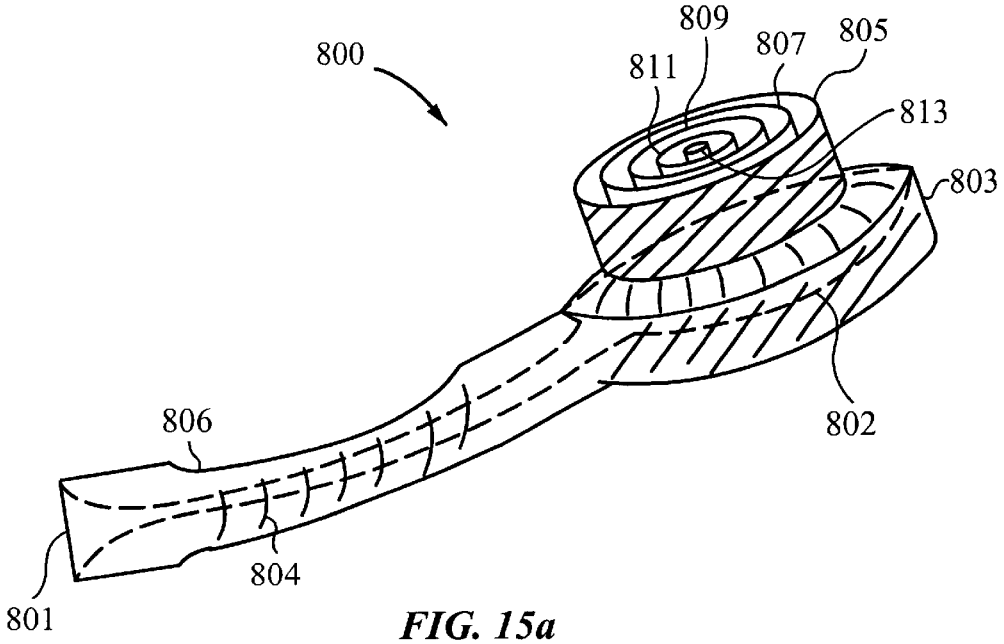
FIGS. 15*a–b* illustrate the cleaning head portion of a cleaning device with a cavity and apertures for delivering cleaning solution to the cleaning head.
Figure 15B:
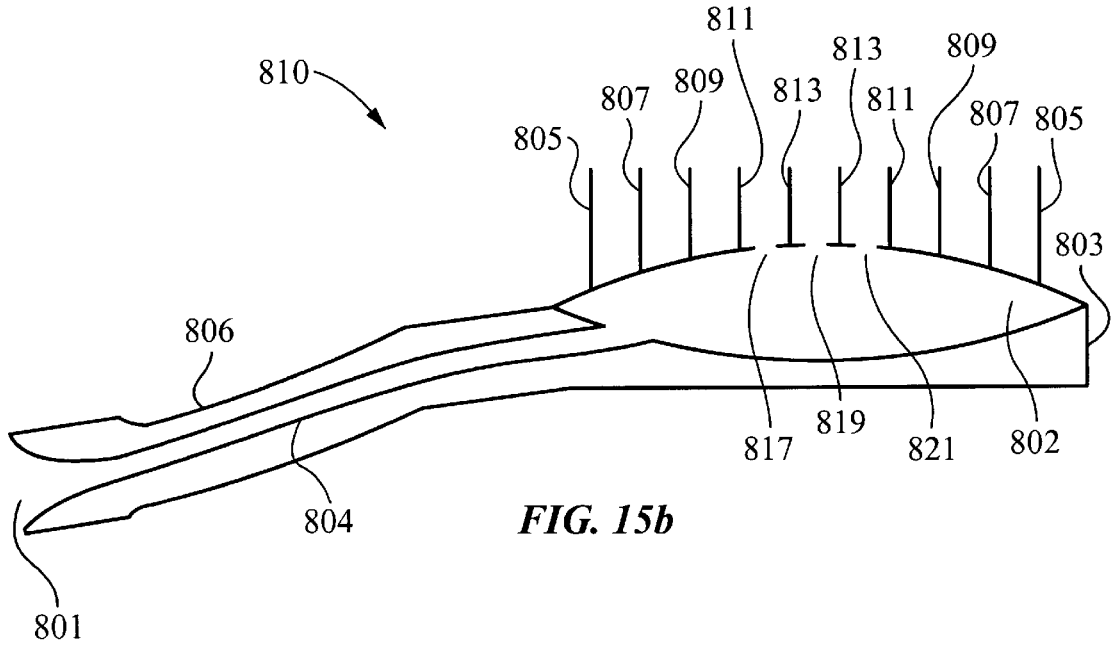

FIGS. 15*a–b* illustrate an embodiment of the current invention that is particularly useful in clinical environments. FIG. 15*a* shows a perspective view of a device 800 that has applications for cleaning wounds and incisions before, during or after medical procedures. The device 800 has a cleaning head 803 with several continues squeegee members 805, 807, 809, 811 and 813. The squeegee members 805, 807, 809, 811 and 813 are preferably positioned concentricity with the smaller squeegees positioned inside of the wall of the next largest squeegee member. The cleaning device 800 is attachable by the end 801 of its neck 806 to a solution delivery system or a vacuum suction system (not shown). FIG. 15*b* illustrates a cross sectional view 810 of the device 800. Solution or vacuum is delivered to the cleaning head 803 through the channel 804 and the reservoir 802. Solution or vacuum is then delivered between the squeegee members 811 and 183 through the apertures 817, 819 and 821. A health care profession or user contacts the squeegee portion of the device against the wounds or incision and applies a cleaning solution or a vacuum depending on the intended outcome of the procedure. The cleaning device 800 shown in FIGS. 15*n–b* is also useful as a dentition cleaning device or for oral procedures where solution and vacuum must be applied to dentition.

Embodiments illustrated in the preceding Figures have shown squeegee walls that protrude in direction substantially parallel with respect to each other. Such devices provided a plurality of primary squeegee cleaning actions in a plurality of wiping directions contained in a single wiping plane or in a plurality of co-linear wiping planes. However, it will be clear from the following description that these embodiments previously described can also include squeegee walls that protrude at nonzero angles relative to each other in order to provide for primary squeegee cleaning action in a plurality of non-coincident wiping planes. Further, it will be clear for the following description that oral cleaning devices and other cleaning devices can be configured with squeegee elements that provide for a plurality of squeegees cleaning actions in a plurality of wiping directions within a plurality of non-coincident wiping planes.

Figure 16A:
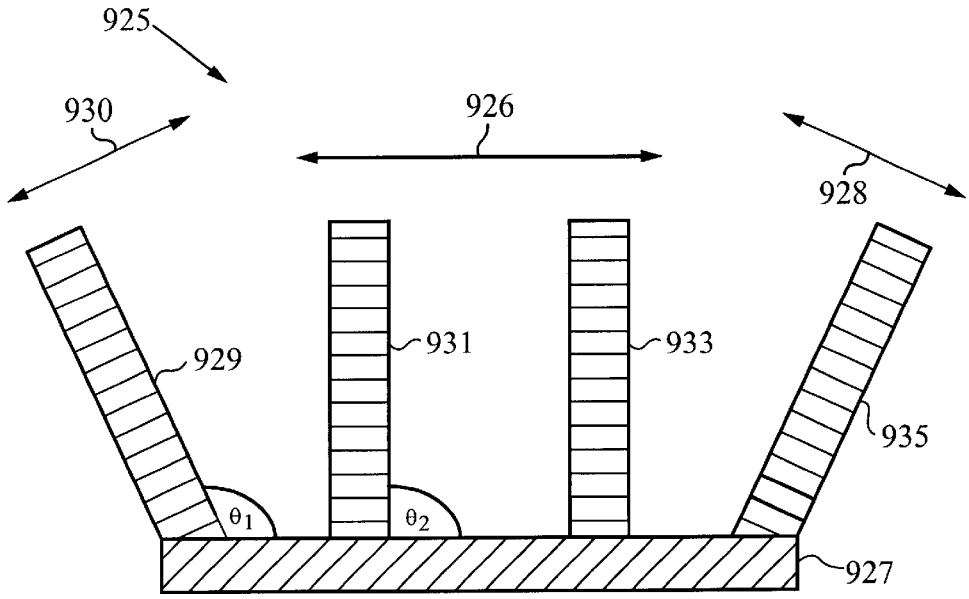
FIGS. 16*a–b* illustrate cross-sectional views of squeegee configurations that provide for primary squeegee cleaning in a plurality of non-coincident wiping planes.

FIG. 16*a* illustrates a cross-sectional view of a squeegee configuration 925 with squeegee walls 929, 931, 933 and 935 that protrude from a squeegee support member 927. The squeegee walls 929 and 935 protrude in a squeegee protruding direction that is at all angle Q1 from the squeegee support member 927 and provide for primary squeegee directions in the non-coincident squeegee wiping planes indicated by the arrows 930 and 928. respectively. The angle Q1, can be any angle between 180 and 90 degrees. The squeegees walls 931 and 933 protrude from the squeegee support 927 in a squeegee protruding direction that is at an angle Q2 relative to the squeegee support 927 to provide for a primary squeegee direction in the wiping plane indicated by the arrow 926. Angle Q2 can also be any angle between 90 and 180 degrees that is different from angle Q1 such as to provide primary squeegee directions in a plurality of non-coincident wiping planes 930, 926 and 928.

Figure 16B:
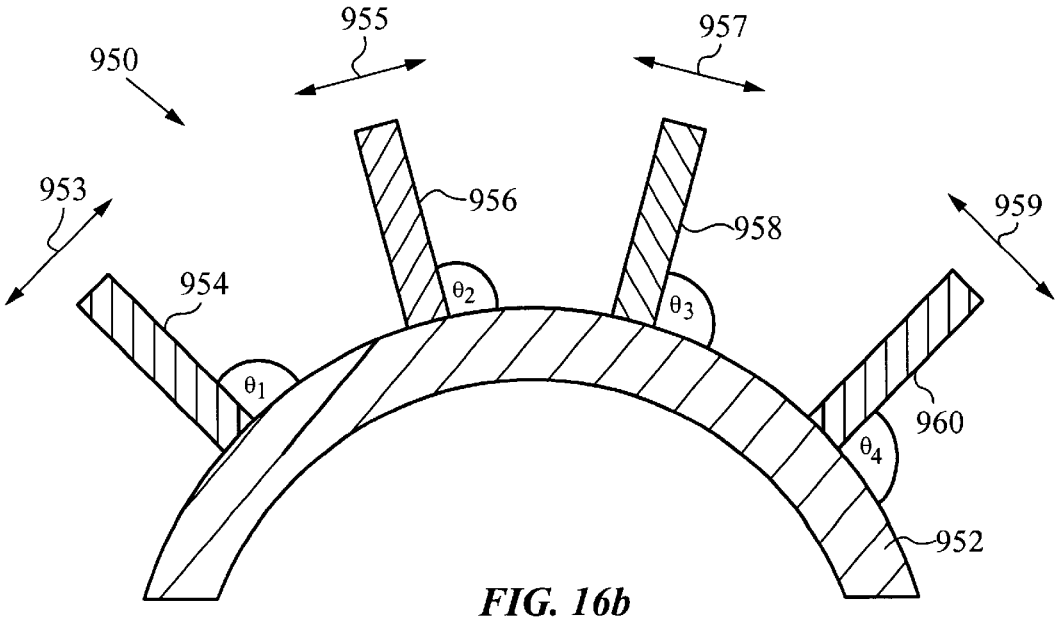

FIG. 16*b* illustrates a cross-sectional view of an alternative squeegee configuration 950. The squeegee configuration 950 has squeegee walls 954, 956, 958 and 960 that protrude in squeegee protruding directions at the angles Θ1, Θ2, Θ3 and Θ2 relative to a contoured squeegee support member 952. The squeegee configuration provides primary squeegee direction in the wiping planes indicated by the arrows 953, 955, 957 and 959, respectively. The squeegee walls described in FIGS. 16*a–b* can belong to individual squeegee segments, continuous squeegees, squeegee networks, squeegee elements with a single terminus end or any combination thereof.

Squeegee configurations with squeegee walls that protrude in non-parallel squeegee protruding directions are utilized in cleaning devices that provide for primary squeegee directions in a plurality of non-coincident wiping planes. Extending, the principles illustrated in FIGS. 16*a–b*, squeegee configurations that have a plurality of squeegee walls that protrude in each of a plurality of squeegee protruding directions provide for a plurality of primary squeegee directions in each of the plurality of non-coincident wiping planes.

Figure 17:
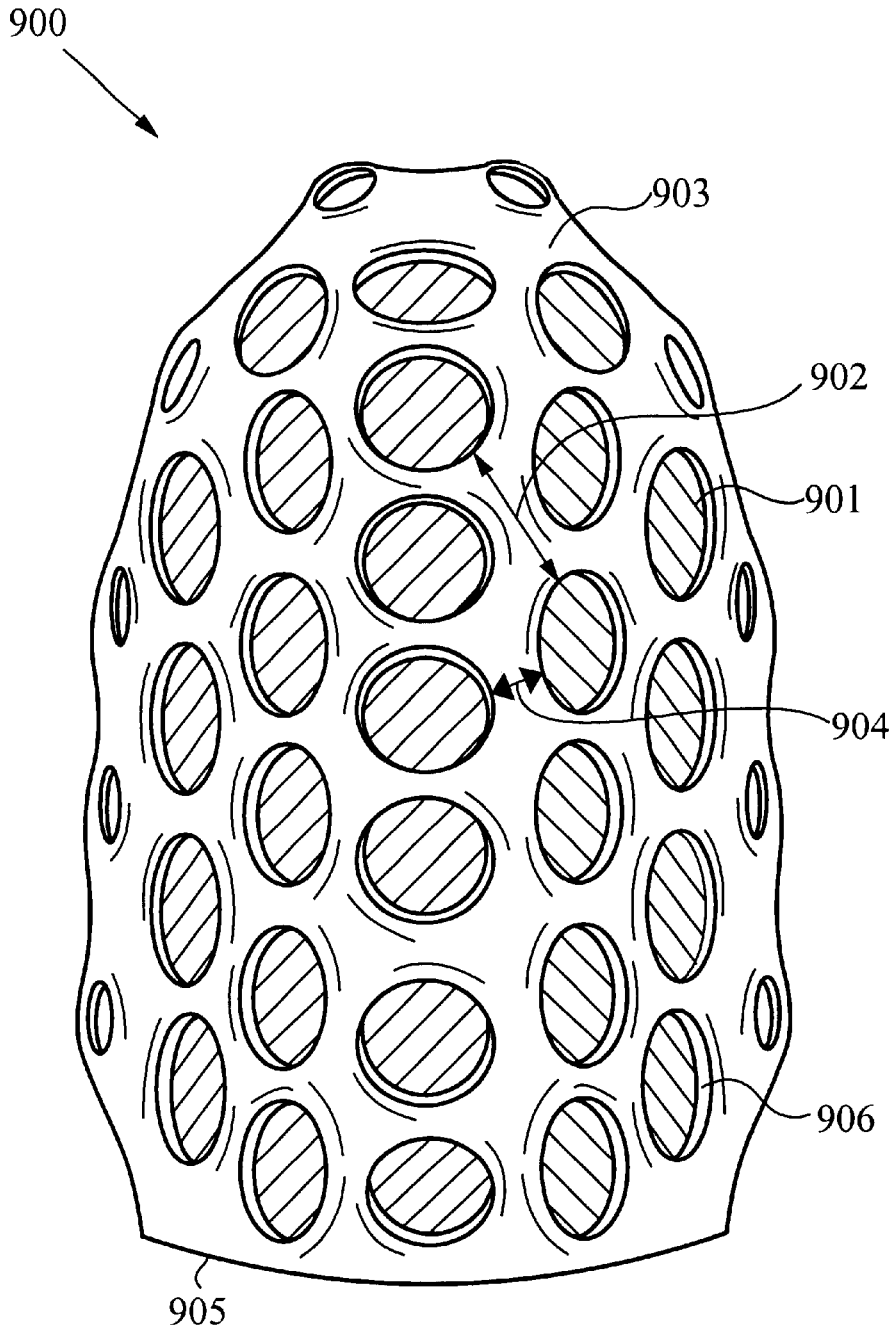
FIG. 17 illustrates a perspective view of a soft tissue messager according to an embodiment of the present invention.

FIG. 17 illustrates a perspective view of a general tissue messager 900 in accordance with the current invention. The tissue messager 900 has a network squeegee cleaning edge surfaces 903 and depressed inner squeegee regions 901. The continuous squeegee walls 906 protrude from a mushroom shaped squeegee support 905. Continuous squeegee walls 906 extend from the recessed inner squeegee regions 901 to form the network squeegee edge surfaces 903. Portions of the network squeegee edge surface 903 between any adjacent depressed inner squeegee regions, indicated by the arrows 902 and 904, provide for squeegee edges that contact and squeegee surfaces during use. The squeegee configuration 900 is one of a number of squeegee configurations that provided for a plurality primary squeegee directions in a plurality of non-coincident planes. Other embodiments are round or have any other three dimensional shapes suitable for the application at hand. Further, three dimensional devices with squeegee segments, continuous squeegee elements, squeegee elements with a single terminus end and combinations thereof, are used within devices to provide for a plurality primary squeegee directions in a plurality of non-coincident wiping planes. A handle (not shown) can be attached to the messager 900 to enhance the functionality or use of the device 900. In a particular embodiment of the invention the device 900 is made from a hard rubber material and is a chewing toy and tooth cleaning device for pets such as dogs. Alternatively, the device 900 is made of soft rubber, silicone of latex and is a gum messager/chewing toy for teething babies.

It will be clear to one skilled in the art that the above embodiment may be altered in many ways without departing from the scope of the invention. For example the dentition cleaning heads can be made to be any variety of color that make the particularly attractive for children. Accordingly, the scope of the invention should be determined by the following claims and their legal equivalents.

What is claimed is:

1. A dentition cleaning device comprising:

a. cleaning head comprising:

i. a first elongated squeegee member protruding from said cleaning head in a squeegee protruding direction with a continuous squeegee wall, said first elongated squeegee member forming an inner squeegee region and an outer squeegee region; and ii. a second elongated squeegee member that is separated from the first elongated squeegee member protruding from said cleaning head; and b. an elongated handle extending out from the cleaning head and in a direction substantially normal to said squeegee protruding direction.

2. The dentition cleaning device of claim 1, wherein said cleaning head is an elongated cleaning head with a front surface, a back surface and an edge surface and wherein said elongated cleaning head has a mean length between 1.0 and 4.0 cm, a mean width between 0.5 and 2.0 cm.

3. The dentition cleaning device of claim 1, wherein said cleaning head further comprises a squeegee support formed from a soft malleable material.

4. The dentition cleaning device of claim 1 wherein said second elongated squeegee member protrudes from said inner squeegee region.

5. The dentition cleaning device of claim 1, wherein at least one of said first elongated squeegee member and said second elongated squeegee member comprising a contoured squeegee edge.

6. The dentition cleaning device of claim 1, wherein at least one of said first elongated squeegee member and the second elongated squeegee member is made from a material selected from the group consisting of silicone, latex, rubber and poly-urethane.

7. The dentition cleaning device of claim 1, wherein said second elongated squeegee member has a terminus end.

8. The dentition cleaning device of claim 1, wherein the first elongated squeegee member and the second elongated squeegee member form a squeegee channel.

9. The dentition cleaning device of claim 8, wherein the squeegee channel has a channel thickness ranging from 1.0 cm to 0.05 cm.

10. The dentition cleaning device of claim 1, further comprising bristles.

11. The dentition cleaning device of claim 1, wherein the second elongated squeegee member is curved.

12. The dentition cleaning device of claim 1, wherein at least one of the first and second elongated squeegee members has a durometer hardness value in a range of 10 to 50 durometers.

13. The dentition cleaning device of claim 1, wherein at least one of the first elongated squeegee member and the second elongated squeegee member comprises tapered squeegee walls.

14. The device of claim 1, wherein said elongated handle is motorized and configured to agitate the cleaning head.

15. A dentition cleaning device comprising a dentition cleaning head comprising curved squeegee segments extending in varying directions with respect to each other and an elongated squeegee member forming an inner squeegee region and an outer squeegee region.

16. The dentition cleaning device of claim 15, wherein the curved squeegee segments protrude from the inner squeegee region.

17. The dentition cleaning device of claim 15, wherein the curved squeegee segments form a squeegee channel with the elongated squeegee member, the squeegee channel having a thickness in a range of 1.0 cm to 0.05 cm.

18. The dentition cleaning device of claim 15, wherein at least one of the curved squeegee segments and the elongated squeegee member has raised and lowered edge surfaces.

19. The dentition cleaning device of claim 15, wherein said dentition cleaning device further comprises a motorized handle for coupling to the cleaning head.

20. The dentition cleaning device of claim 15, wherein at least one of the curved squeegee segments is made from a material selected from the group consisting of silicone, latex, rubber and poly-urethane.

21. The dentition cleaning device of claim 15, further comprising bristles.

22. A dentition cleaning device comprising a squeegee portion, wherein said squeegee portion protrudes with at least one squeegee cleaning edge in at least two protruding squeegee directions from a support and wherein said the squeegee portion provides squeegee cleaning action substantially normal to said at least two squeegee protruding directions in a least two non-coincident wiping planes, the device further comprising a bristles.

23. The dentition cleaning device of claim 22, wherein said squeegee portion extends in at least two non-parallel directions of each of said at least two non-coincident wiping planes to provide at least two a non-parallel wiping directions in each of said at least two non-coincident wiping planes.

24. The dentition cleaning device of claim 22, wherein said squeegee portion comprises a contoured squeegee edge with raised and lowered surfaces.

25. The cleaning device of claim 22, wherein said squeegee portion is made from a material selected from the group consisting of silicone, latex, rubber and poly-urethane.

26. The dentition cleaning device of claim 22, further comprising a motorized handle for coupling to said squeegee portion.

27. A dentition cleaning device comprising a cleaning head comprising a plurality of curved squeegee segments and bristles protruding from the cleaning head.

28. The dentition cleaning device of claim 27, wherein said plurality of curved squeegee segments extend two or more directions.

29. The dentition cleaning device of claim 27, wherein said squeegee segments are made from a material selected from the group consisting of silicone, latex, rubber and poly-urethane.

30. The dentition device of claim 27, further comprising a motorized handle for coupling to the cleaning head.

31. A device for applying a material to dentition, the device comprising:

a. a cleaning head with a plurality of squeegee compartments forming continuous squeegee walls, at least a portion of which is are tapered and, wherein the materials is placed within the squeegee compartment and expelled onto the dentition from the plurality of squeegee compartments by wiping; and b. an elongated handle extending out the from the cleaning head and in a direction substantially normal to said squeegee protruding direction.

32. The device of claim 31, wherein the elongated handle is motorized and configured to agitate the cleaning head.

33. A device comprising:

a. a plurality of curved squeegee segments; and b. bristles, wherein the at least one of the plurality of curved squeegee segments and the bristle are configured to simultaneously wipe dentition.

34. The device of claim 33, wherein at least a portion of the plurality of curved squeegee segments is tapered.

35. The device of claim 33, further comprising a handle attached to the cleaning head for manually wiping dentition.

36. The device of claim 33, further comprising motorized handle for automatically wiping dentition.

37. The device of claim 33, wherein at least one of the plurality of curved squeegee segments is contoured.

38. A system comprising:

a. an applicator head with at least one curved squeegee element and bristles protruding from the applicator head; and b. a motorized handle for coupling to the applicator head.

39. The system of claim 38, further comprising means for placing an oral care material on the applicator head.

* * * * *